US008622796B2

(12) United States Patent
Nagano

(10) Patent No.: US 8,622,796 B2
(45) Date of Patent: Jan. 7, 2014

(54) GAMING SYSTEM THAT NAVIGATES DEALER IN GAME ADVANCEMENT AND PREVENTS FRAUD

(75) Inventor: Hiroyuki Nagano, Tokyo (JP)

(73) Assignees: Universal Entertainment Corporation, Tokyo (JP); Aruze Gaming America, Inc., Las Vegas, NV (US)

( * ) Notice: Subject to any disclaimer, the term of this patent is extended or adjusted under 35 U.S.C. 154(b) by 302 days.

(21) Appl. No.: 12/814,784

(22) Filed: Jun. 14, 2010

(65) Prior Publication Data

US 2010/0331085 A1 Dec. 30, 2010

(30) Foreign Application Priority Data

Jun. 25, 2009 (JP) ..... 2009-151232

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2011.01) |

(52) U.S. Cl.

USPC ..... 463/9; 705/37

(58) Field of Classification Search

USPC ..... 463/9; 705/37

See application file for complete search history.

(56) References Cited

U.S. PATENT DOCUMENTS

| | | | | |
|---|---|---|---|---|
| 5,605,334 | A | 2/1997 | McCrea, Jr. | |
| 5,779,546 | A * | 7/1998 | Meissner et al. | 463/25 |
| 6,403,908 | B2 * | 6/2002 | Stardust et al. | 209/587 |
| 7,419,160 | B1 | 9/2008 | D'Ambrosio | |
| 2005/0164793 | A1 * | 7/2005 | Merimovich et al. | 463/42 |
| 2009/0026700 | A2 | 1/2009 | Shigeta | |

* cited by examiner

*Primary Examiner* — Melba Bumgarner
*Assistant Examiner* — Jason Pinheiro
(74) *Attorney, Agent, or Firm* — Lexyoume IP Meister, PLLC.

(57) ABSTRACT

The present invention provides a gaming system that can allow a game to be appropriately advanced even by an inexperienced dealer by way of navigating the dealer in game advancement, thereby allowing fraud to be avoided and cost to be reduced. An image input device, which captures images for displaying to players playing the game at a plurality of stations, captures an image of a side of a game portion on which the dealer is positioned to include card placement areas. Then, a controller performs image recognition processing of comparing image data of the card placement areas captured by the image input device with comparative image data stored in memory. Thereafter, in a case in which image recognition processing results in an image showing a card being included, the score of the card game is calculated based on recognition results of the images showing cards.

8 Claims, 27 Drawing Sheets

BET END INSTRUCTIONAL IMAGE

FIRST PLACEMENT INSTRUCTIONAL IMAGE

FIRST CARD PLACEMENT WARNING IMAGE

FIRST CARD PLACEMENT WARNING IMAGE

FIRST CARD PLACEMENT WARNING IMAGE

GAMING SYSTEM THAT NAVIGATES DEALER IN GAME ADVANCEMENT AND PREVENTS FRAUD

CROSS REFERENCE TO RELATED APPLICATIONS

This application is based on and claims the benefit of priority from Japanese Patent Application No. 2009-151232, filed on Jun. 25, 2009, the content of which is incorporated herein by reference.

BACKGROUND OF THE INVENTION

1. Field of the Invention

The present invention relates to a gaming system that navigates a dealer in game advancement while preventing fraud.

2. Related Art

Various table games are known conventionally, and among the table games, there exists a game genre called card games.

Among card games, for example, there is a game called baccarat as disclosed in the specification of U.S. Pat. No. 7,419,160 (hereinafter referred to as Patent Document 1). Here, baccarat is a game in which bets are made on any of a "Player (player position)", "Banker (banker position)", and "Tie (draw)" (however, there may be a case in which "Tie" is not a target for betting), which are the bet targets, and awards winnings, based on the bet amount that is bet, to a player having bet on a bet target of a winning side. In addition, in baccarat, cards are distributed to the "player" side and the "banker" side, and winnings are determined based on the cards thus distributed.

Card games such as baccarat are established in casinos, and since a dealer, for casino games, advances the game, it is necessary for the dealer to be proficient in game advancement. However, for countries in which development of casinos has only started, there has been a problem in that there is a shortage of dealers proficient in game advancement.

In addition, a system for advancing a game by reading information embedded in cards used for a card game, by means of an IC chip embedded therein or information printed thereon with special ink, is disclosed in U.S. Pat. No. 5,605,334 (hereinafter referred to as Patent Document 2). In such a system, all cards require the IC chip or printing with the special ink, and therefore a manufacturing cost of the cards becomes high. Cards used in casinos are generally discarded unconditionally after used once or for a predetermined number of times in a game, in order to avoid fraud. This is for avoiding a numeral or a symbol of the card from being distinguished from a reverse face of the card placed face-down due to a flaw or a fold made during use, and for avoiding marking on the card by a malicious player. As a result, with a method of using an IC chip storing data to be read attached to the card, such as sealing an IC tag that can communicate in a contactless manner in the card and the like, a running cost becomes high.

In addition, a system that is provided with a reading device in a card shoe that accommodates the cards used in the card game, and that reads information of cards dispensed from a card shoe has been disclosed in U.S. Patent Application Publication No. 2009026700. (hereinafter referred to as Patent Document 3). In such a case, a UV reactive code is printed on the card itself, and the information of the card is read using a black-light sensor at an outlet opening of the card shoe; however, the cost of printing on the card is incurred, while a system related to the card shoe must be provided specially.

The burden on the system due to adding components to constitute the system becomes large, and the failure rate may increase by becoming complicated, and thus the cost rising as a whole is a concern.

Meanwhile, card games generally have strict rules for order, method, position and the like in the distribution of cards. In addition, the timing and duration of betting are complexly defined for each game. In card games, the dealer's handling of cards based on the numeral and the symbol on the card is naturally important; however, the dealer's behavior before and during the distribution of cards is even more important for determining a result of a game.

As described above, a dealer is required to strictly act during the distribution of cards, handling of bets, advancement of a game and the like; however, in a situation where the number of experienced dealers is insufficient, there is a need for a system allowing an inexperienced dealer to strictly advance a game.

SUMMARY OF THE INVENTION

The present invention has an object of providing a gaming system that can allow a game to be appropriately advanced even by an inexperienced dealer by way of navigating the dealer in game advancement, thereby allowing fraud to be avoided and cost to be reduced.

In a first aspect of the present invention, a gaming system that executes a card game, comprising: a plurality of stations; a control unit that transmits and receives information related to a game with the plurality of stations, and controls advancement of the game; a game portion that has a flat surface and has a plurality of card placement areas on which a required number of cards, among cards used in the card game, in order to determine an outcome of the game is placed; an image input device that captures an image of a side of the game portion on which a dealer is positioned which contains the plurality of card placement areas, and transmits image data thus captured to the control unit in order to display to players playing the game at the plurality of stations; a card shoe that accommodates cards used in the card game; and memory that stores a game advancement program related to advancement of the game, and stores images captured of card placement areas of the game portion and comparative image data for performing image recognition processing, wherein the control unit includes a controller that executes processing of: (a) starting the card game based on the game advancement program, (b) executing image recognition processing of comparing image data of the card placement area captured by the image input device with the comparative image data stored in the memory, and (c) calculating a score of the card game according to the game advancement program stored in the memory based on a recognition result of an image showing the card, in a case where the image recognition processing results in an image showing the card being included.

According to the first aspect of the invention, the image input device, which captures images for displaying to players playing the game at the plurality of stations, captures an image of a side of the game portion on which the dealer is positioned to include the card placement areas. Then, the controller performs image recognition processing of comparing image data of card placement areas captured by the image input device with comparative image data stored in the memory. Thereafter, in a case in which the image recognition processing results in an image showing a card being included, the score of the card game is calculated based on the recognition result of the image showing the card. Therefore, the controller can calculate the score of the game by recognizing cards placed on the card placement areas based on image data, which is captured by the image input device in order to display advancement of the game to the players playing the game at the stations. Accordingly, since the gaming system is configured with a simple configuration without special devices needing to be added for card recognition, the cost can be controlled. In addition, it is possible to prevent fraudulence such as placing a different card, since actions of the dealer are captured by the image input device and always observed by the players, and cards are recognized by comparing a card pulled out from the card shoe and placed on a card placement area with comparative image data stored in the memory.

According to a second aspect of the present invention, in the gaming system as described in the first aspect, the gaming system according to claim 1, wherein the image recognition processing is performed a plurality of times in the processing of (b), and in a case of being the same recognition result, the processing of (c) is performed.

According to the second aspect of the invention, image recognition processing to recognize a card is performed a plurality of times, and in a case where the result of image recognition processing performed each time is the same result, calculation processing of a score is performed. As a result, it is possible to prevent false recognition since image recognition processing is performed a plurality of times, and it is possible to accurately calculate the score.

According to a third aspect of the present invention, a gaming system that executes a card game, comprising: a plurality of stations; a control unit that transmits and receives information related to a game with the plurality of stations, and control advancement of the game; a game portion that has a flat surface and has a plurality of card placement areas on which a required number of cards, among cards used in the card game, in order to determine an outcome of the game are placed; an image input device that captures an image of a side of the game portion on which a dealer is positioned which contains the plurality of card placement areas, and transmits image data thus captured to the control unit in order to display to players playing the game at the plurality of stations; a card shoe that accommodates cards used in the card game; memory that stores a game advancement program related to advancement of the game, and stores images captured of card placement areas of the game portion and comparative image data for performing image recognition processing; and an instructional device that provides information related to advancement of the game to the dealer, wherein the control unit includes a controller that executes processing of: (a) starting the card game, and presenting on the instructional device drawing out a card from the card shoe based on the game advancement program, (b) executing image recognition processing of comparing image data of the card placement area captured by the image input device with the comparative image data stored in the memory, (c) calculating a score of the card game according to the game advancement program stored in the memory based on a recognition result of an image showing the card, in a case where the image recognition processing results in an image showing the card being included, (d) repeating recognition of the image showing the card a plurality of times, in a case of an image showing the card not being included in the processing of (b), (e) determining whether the card is further placed on any of the plurality of card placement areas, based on the score calculated in the processing of (c), (f) presenting on the instructional device drawing out a card from the card shoe based on the game advancement program, in a case where it is determined to further place a card in the processing of (e), (g) determining winning of the game, in a case where the processing of (a) to (f) has been repeated a predetermined number of times, and it is determined not to further place the card in the processing of (e), and (h) presenting a result of the game on the instructional device based on the processing of (c).

According to the third aspect of the invention, the image input device, which captures images in order to be displayed to players playing the game at the plurality of stations, captures an image of a side of the game portion on which the dealer is positioned to include the card placement areas. Then, the controller performs image recognition processing of comparing image data of card placement areas captured by the image input device with comparative image data stored in the memory. Thereafter, in a case in which image recognition processing results in an image showing a card being included, the score of the card game is calculated based on the recognition result of the image showing the card, it is determined whether to further place a card, and this determination is indicated to the instructional device. Therefore, the controller can calculate the score of the game by recognizing cards placed on the card placement areas based on image data, which is captured by the image input device in order to display advancement of the game to the players playing the game at the stations. Accordingly, since the gaming system is configured with a simple configuration without special devices needing to be added for card recognition, the cost can be controlled. In addition, it is possible to prevent fraudulence such as placing a different card, since the actions of the dealer are captured by the image input device and always observed by the players, and cards are recognized by comparing a card pulled out from the card shoe and placed on a card placement area with comparative image data stored in the memory. Furthermore, the game can be advance even by an inexperienced dealer since whether or not to place a card is indicated by the instructional device.

In a fourth aspect of the present invention, in the gaming system as described in the third aspect wherein in a case where even by repeating recognition of an image showing the card a predetermined number of time in the processing of (d) cannot recognize the card, a matter of not being able to recognize is presented on the instructional device.

According to the fourth aspect of the invention, in addition to the gaming system as described in the third aspect, the controller performs image recognition processing of recognizing a card a plurality of times, and in a case in which the result of image recognition processing performed each time is the same result, performs calculation processing of a score. As a result, it is possible to prevent false recognition since image recognition processing is performed a plurality of times, and thus it is possible to accurately calculate the score.

In a fifth aspect of the present invention, in the gaming system as described in the third aspect wherein the processing of (b) and (c) is repeated a plurality of time, and in a case where the score calculated each time is the same score, the processing of (e) is performed.

In a sixth aspect of the present invention, in the gaming system as described in the third aspect wherein the plurality of standard image data is stored multiply in the memory for each group of cards used in the game.

According to the sixth aspect of the invention, in the gaming system as described in the third aspect, the comparative image data is stored in the memory for each group of cards used in the game. As a result, it is possible to perform image recognition processing of a card even in a case in which a plurality of groups of cards is accommodated in the card shoe.

According to the present invention, it is possible to provide a gaming system that can allow a game to be appropriately advanced even by an inexperienced dealer by way of navigating the dealer in game advancement, thereby allowing fraud to be avoided and cost to be reduced.

DETAILED DESCRIPTION OF THE INVENTION

Embodiments of the present invention are explained below with reference to the drawings.

Figure 1:
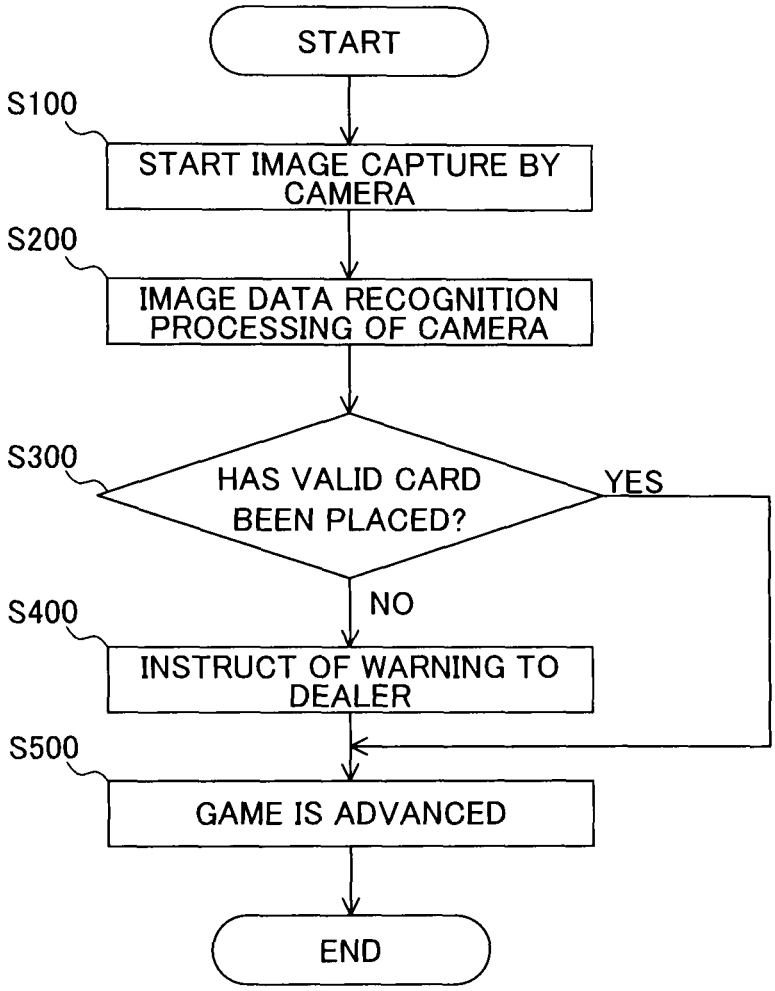
FIG. 1 is a flowchart schematically showing a processing sequence of a gaming system according to an embodiment of the present invention.

Although described later in detail, as shown in FIG. 1, the CPU 81 starts image capture with the camera 20 in response to the start of a game (Step S100), and performs recognition processing of image data thus captured by the camera 20 (Step S200). Then, it is determined whether the card placed is the correct card (Step S300), a warning to the dealer is performed in a case of not being the correct card (Step S400), and the game is advanced in a case of being the correct card (Step S500).

Figure 2:
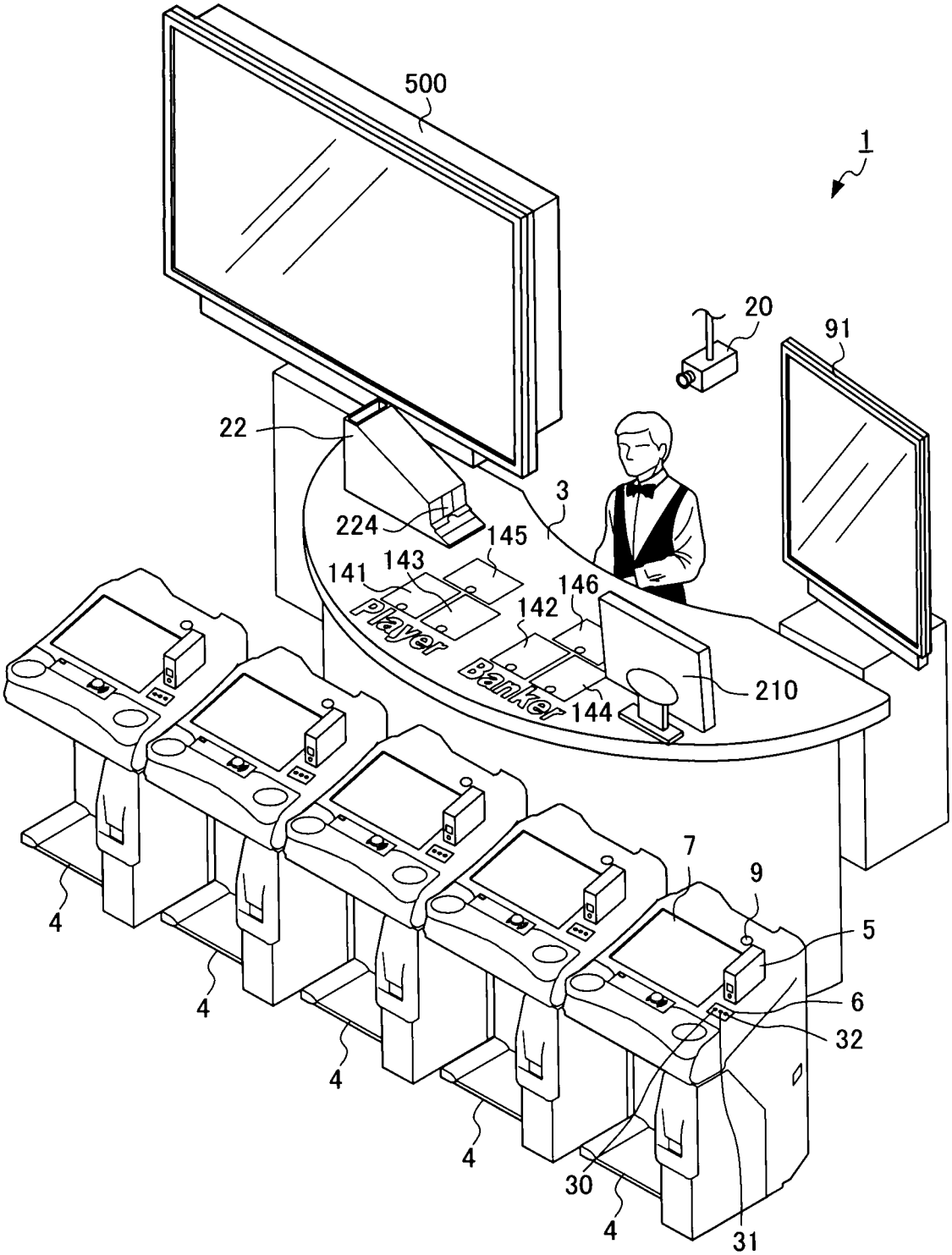
FIG. 2 is a perspective view of the gaming system according to the embodiment of the present invention.
Figure 3:
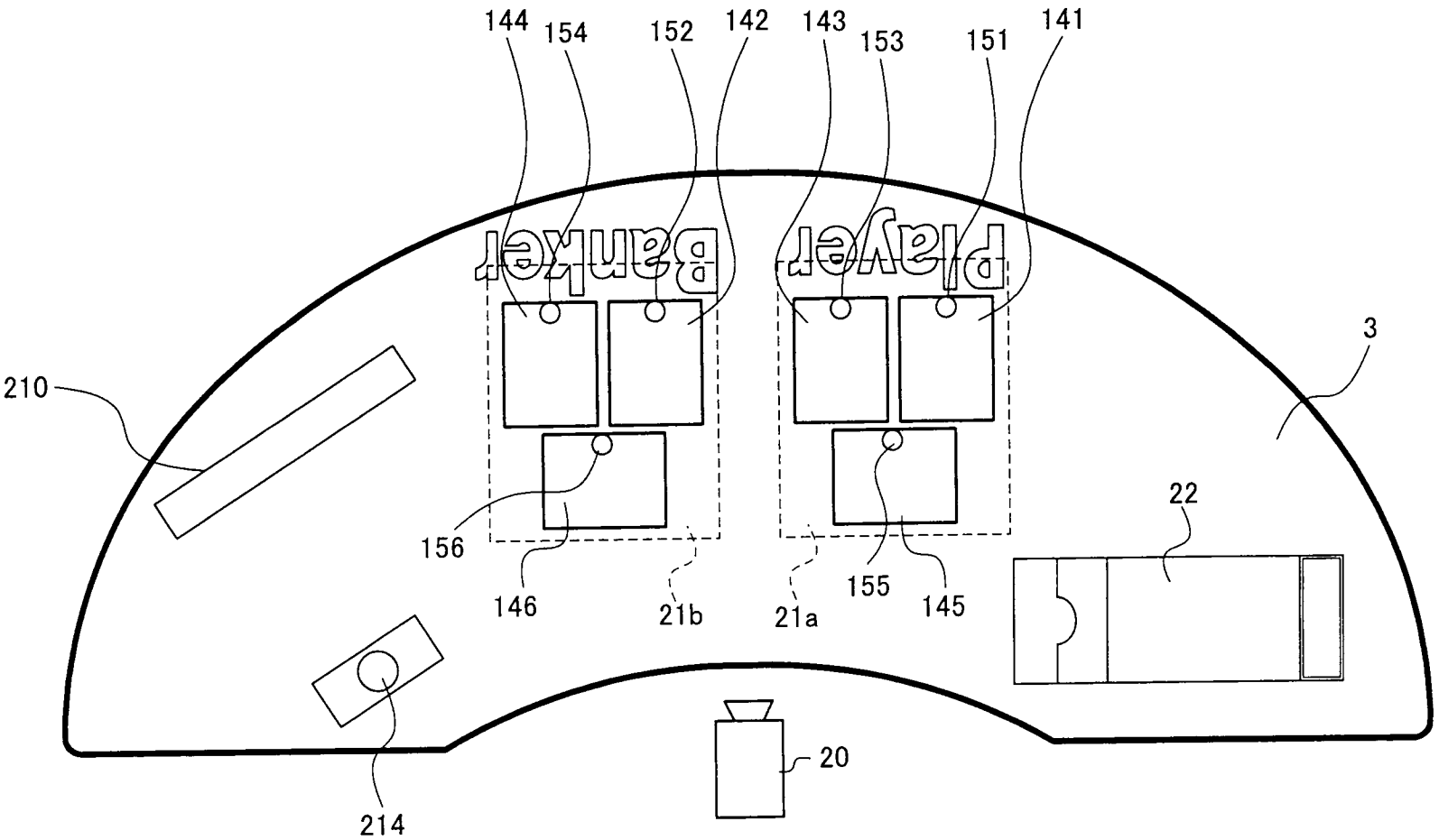
FIG. 3 is an enlarged view of a game portion of the gaming system shown in FIG. 2.
Figure 4:
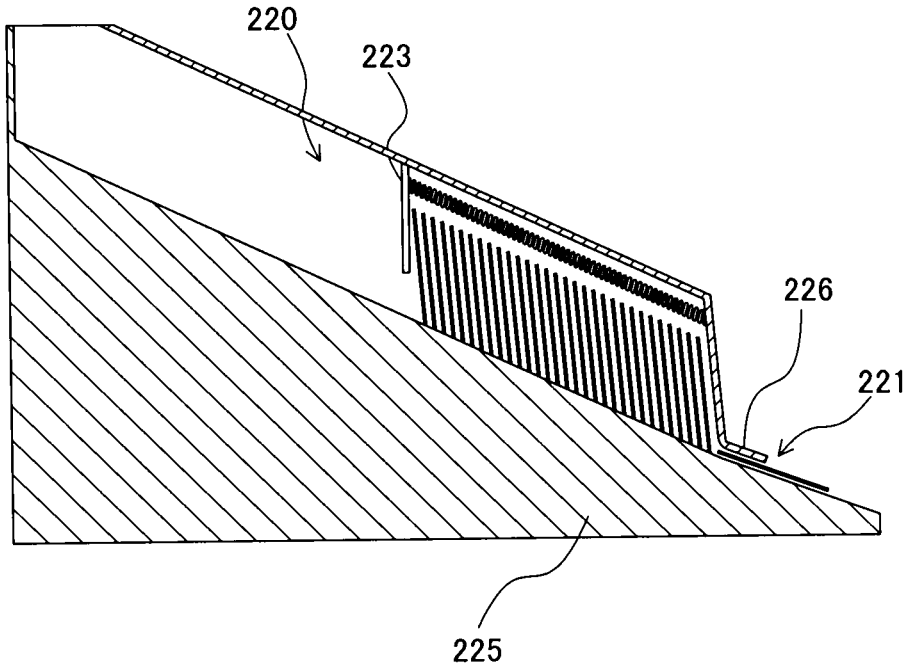
FIG. 4 is a horizontal cross-sectional view of a card shoe of the gaming system shown in FIG. 2.

Referring to FIGS. 2 and 4, a gaming system 1 of the present embodiment will be explained. FIG. 2 is a perspective view schematically showing an example of the gaming system 1. FIG. 3 is a view from above a game portion 3 included in the gaming system 1. FIG. 4 is a horizontal cross-sectional view of the card shoe 22.

Figure 5:
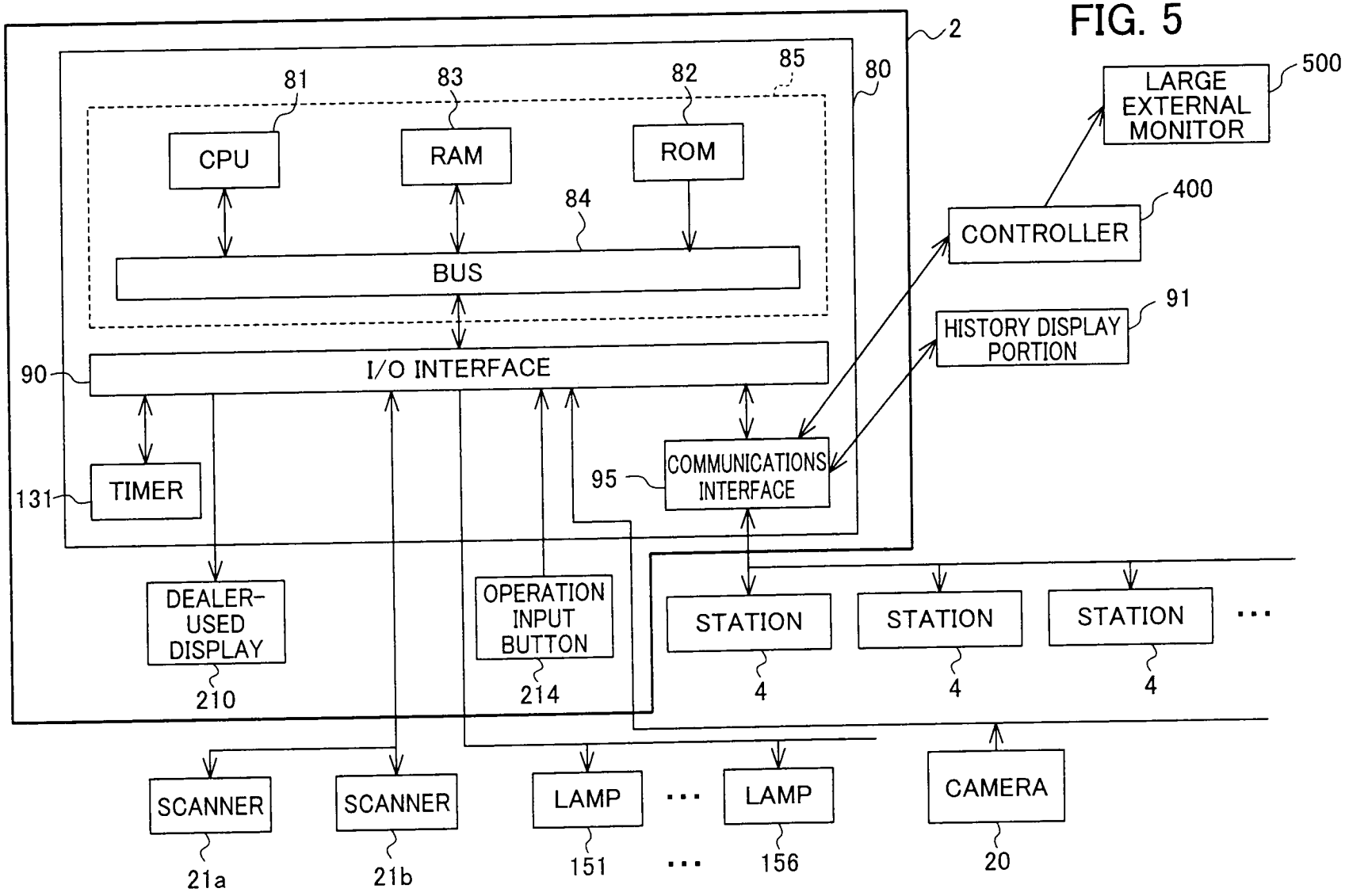
FIG. 5 is a block diagram showing an internal configuration of a control unit according to the embodiment of the present invention.

The gaming system 1 of the present embodiment is configured with a plurality of stations 4, a game portion 3, and a control unit 2 (described later in FIG. 5). In addition, a history display portion 91 is provided at a position viewable by players playing the game at the plurality of stations 4. Furthermore, a large external monitor 500 is provided at a position viewable by people surrounding the plurality of stations 4.

The control unit 2 controls the entirety of the gaming system 1. In addition, the control unit 2 includes a dealer-used display 210 that the dealer uses, an operation input button 214 (FIG. 3), and a CPU 81 (described later in FIG. 5), and performs control of the entirety of the gaming system 1 according to operations by the dealer. The dealer-used display 210 is positioned to be unviewable by players seated at each of the stations 4. In addition, the body portion (not illustrated) of the control unit 2 is positioned below the game portion 3.

The stations 4 are terminals operated by players. The stations 4 accept a bet operation from a player seated at a seat (not illustrated) prepared in front of the station 4, and furthermore, performs processing of paying out game winnings. The station 4 is provided with an image display device 7. Players seated at each station 4 participate in a baccarat game by performing a BET input on any of a "Player (player position)", "Banker (banker position), and "Tie (draw)".

The station 4 is provided with a game media receiving device 5 into which game media such as medals used in a game is inserted, a control portion 6 composed of a plurality of control buttons to which predetermined instructions are input by a player and the like, and an image display device 7 on which images related to a baccarat game and the like are displayed. Then, the player can participate in a game while looking at an image displayed on the image display device 7 by operating the control portion 6 and the like.

Furthermore, at the top right of the image display device 7 of each station 4, a speaker 9 is provided that is capable of outputting sound.

The control portion 6 is provided at a side of the image display device 7 of the station 4. A select button 30, cash out button 31, and help button 32 are disposed on the control portion 6.

The select button 30 is a button that is pressed, after performing a BET operation, when selecting the BET operation. In addition, even in cases other than a BET operation, the select button 30 is a button that is pressed when selecting an input performed by the player.

The cash out button 31 is a button usually pressed after a game ends, and when the cash out button 31 is pressed, game media is refunded from a payout opening according to the credits owned by the player.

The help button 32 is a button pressed in a case where operation methods of the game and the like are unclear, and when the help button 32 is pressed, a help screen showing a variety of operational information is displayed immediately thereafter on the image display device 7.

As shown in FIG. 3, the game portion 3 includes: card placement areas 141 to 146 in which cards used in a baccarat game are to be placed; lamps 151 to 156 as indicators for a dealer, respectively provided in the card placement areas 141 to 146; scanners 21*a* and 21*b* as image input devices disposed on a lower face side of the card placement areas 141 to 146, and a card shoe 22 for storing cards to be distributed. In addition, a camera 20 is provided as an image input device that captures images of the dealer side of the game portion 3.

The card placement areas 141 to 146 are areas in which cards are to be placed in game advancement. The dealer places cards one by one in a predetermined order in the card placement areas 141 to 146. In the gaming system 1 of the present embodiment that provides a baccarat game, the opposing groups required for determining winning or losing of the game are player side and banker side. For each opposing group, three of the card placement areas 141 to 146 are provided. Since the present embodiment is of a gaming system that performs a baccarat game, the number of cards necessary in order to determine winning/losing of a game is from 4 to 6.

The lamps 151 to 156 are provided as indicators for navigating the dealer on the card placement area on which a card should be placed, and the lamps 151 to 156 respectively correspond to the card placement areas 141 to 146. For example, when the lamp 151 is illuminated, the dealer can understand that the card should be placed on the card placement area 141. It should be noted that the lamps 151 to 156 are each configured with LED luminous bodies.

The camera 20 captures images of a side of the game portion 3 on which the dealer is positioned. In the present embodiment, it is provided in the vicinity overhead the position at which the dealer stands, as shown in FIG. 2. Then, the camera 20 captures images of the top of the game portion 3 focusing on the area where the hand of the dealer advances the game, so as to include the card placement areas 141 to 146 provided on the game portion 3 (refer to FIGS. 1 and 2). Therefore, the camera 20 captures images of the top side of each card placed on each of the card placement areas 141 to 146. Image capturing by this camera 20 is normally performed during a game, and this image is relayed to the stations 4 and the large external monitor 500. In addition, image data captured by the camera 20 undergoes image analysis processing in the control unit 2. More specifically, a card positioned at the card placement areas 141 to 146 is recognized, and the value and suit of this card is determined. This processing is described later.

The card shoe 22 stores cards to be distributed in a game. As shown in FIGS. 2 and 4, the card shoe 22 is provided with a card storage portion 220 that accommodates the cards, and a hold-down plate 223 that holds the cards to be stored in the card storage portion 220 toward the card outlet opening 221.

The card storage portion 220 accommodates the cards used in the game. In the present embodiment, it can accommodate a plurality of groups (decks) of cards. In addition, the cards are stored such that a reverse face side of the card is directed toward the card outlet opening 221.

As used herein, the reverse face of the card is a face on which a numeral or a symbol is not marked. On the reverse face of the card, a pattern or a picture that is different from deck to deck is printed. In addition, an obverse face of the card is a side on which a numeral or a symbol is marked. The numeral of the card is any one of the numerical numbers 1 to 10, provided for each of the four suits, diamonds, hearts, clubs, and spades. The symbol of the card is any one of symbols Jack, Queen, and King, representing numerical numbers 11 to 13 respectively, provided for each of the four suits. In addition, a Joker can be included depending on a type of card game.

The card outlet opening 221 is provided at an end of the card storage unit 220, through which cards stored in the card storage unit 220 are taken out one by one. More specifically, on an end-side face of the card storage unit 220, an exposed portion 224 is formed through which a card in the front row is exposed. When a dealer touches a card that is in a front row and pushes downward in this state, the front row card is pushed out from the card outlet opening 221 formed at the lower side of the exposed portion 224. In the card outlet opening 221, an upper plate 226 is provided from an upper face of a base portion 225, which is a base of the card shoe 22, with a gap allowing a card to pass therethrough, and cards pushed out from the exposed portion 224 are pushed out therethrough one by one.

The scanners 21*a* and 21*b* are disposed below the card placement areas 141 to 146 and scan the lower face of the cards placed in the card placement areas 141 to 146. More specifically, the scanners 21*a* and 21*b* are embedded in the game portion 3 so as to correspond to a player side and a banker side, respectively. In other words, the scanner 21*a* is disposed below the card placement areas 141, 143, and 145 on the player side, and scans the card placement areas 141, 143, and 145 as a whole. In addition, the scanner 21*b* is disposed below the card placement areas 142, 144, and 146 on the banker side, and scans the card placement areas 142, 144, and 146 as a whole. The scanners 21*a* and 21*b* are optical scanners in the present embodiment; however, other types of scanners can also be used, and alternatively, the card can be recognized by image recognition by a camera and the like.

A history display portion 91 is a display on which game history such as which side among a player side and banker side won in each game up to that previous. Details thereof are described later.

A large external monitor 500 is a display on which live-pictures such as game advancement, demo screens, and the like are displayed. Details thereof are described later.

Game advancement is described later with reference to FIGS. 7 to 26.

A configuration of the control unit is hereinafter described with reference to FIG. 5. FIG. 5 is a block diagram showing a functional configuration of the control unit.

A main control portion 80 of the control unit 2 has a microcomputer 85 that is mainly configured with a CPU 81, ROM 82, RAM 83, and a bus 84 that carries out data transmission between each of these.

The CPU 81 is connected to the dealer-used display 210, a card reader 212, and operation input button 214 via an I/O interface 90.

The CPU 81 sends picture data of various screens, which are described later in FIGS. 10, 11, 15, 17, 19, 21 to 23, and 26 to the dealer-used display 210. The CPU 81 determines whether a bet end instruction signal has been received from the operation input button.

In addition, the CPU 81 is connected via the I/O interface 90 to a timer 131 capable of measuring time. Moreover, the CPU 81 is connected via the I/O interface 90 to the lamps 151 to 156. The lamps 151 to 156 emit light of each color when navigating the dealer of a card placement area based on an output signal from the CPU 81.

In addition, the camera 20 and scanners 21*a* and 21*b* are connected to the I/O interface 90, and the CPU 81 receives image data of an upper face and lower face of cards that have been placed on the card placement areas 141 to 146 from the camera 20 and the scanners 21*a* and 21*b*.

Furthermore, a communications interface 95 is connected to the I/O interface 90, and a main control portion 80 performs transmission and reception of data such as BET information and dividend information between each station 4 via this communications interface 95.

Additionally, the history display portion 91 is connected to the communications interface 95, and the main control portion 80 performs transmission and reception of data of game history with the history display portion 91.

Moreover, the large external monitor 500 is connected to the communications interface 95 via the controller 400, and the main control portion 80 performs transmission and reception of image data and the like with the large external monitor 500.

Live pictures of game advancement and the like, demo screens, and the like are displayed on this large external monitor 500. In this way, it is possible to attract the interest of people around the large external monitor 500.

The ROM 82 in the main control portion 80 stores a game advancement program for implementing basic features of the control unit 2, and more specifically a program for controlling various devices provided in the game portion 3 and a program for controlling each station 4, as well as holding winnings tables, data indicating a predetermined time T, data indicating a specific value TT, and the like.

The RAM 83 is memory that temporarily stores various data computed by the CPU 81, and temporarily stores BET information sent from each station 4, image data captured by the camera 20, image data of cards scanned by the scanners 21*a* and 21*b*, data related to the results of processing executed by the CPU 81, and the like, for example.

In addition, the RAM 83 also stores the standard image data. The standard image data is image data captured in advance of the card placement areas 141 to 146 in a state in which no cards have been placed thereon, and is image data captured in advance of cards used by the gaming system 1. Furthermore, the standard image data is comparative image data for comparing with image data captured by the camera 20. The standard image data is provided for each deck of cards and includes image data of the reverse face of the card and image data of the card for each numeral (1 to 9) and each symbol (J, Q, K) in each suit. An image of the card placed in the card placement areas 141 to 146 is compared against the standard image data in verification/warning processing (FIG. 20) described later. The standard image data can be stored in the ROM 82.

The CPU 81 controls various devices provided to the game portion 3 and executes control processing along with game advancement, based on data and programs stored in the ROM 82 and RAM 83.

In addition to control processing along with game advancement, the CPU 81 performs transmission and reception of data with each station 4, and has functions for controlling each station 4 to advance a game. More specifically, BET information sent from each station 4 is received. Furthermore, dividend amounts to be paid out at each station 4 are calculated based on a game result ("Player (player position) winning, "Banker (banker position) winning, or "Tie (draw)") and BET information sent from each station 4 by referring to a dividend table stored in the ROM 82.

Figure 6:
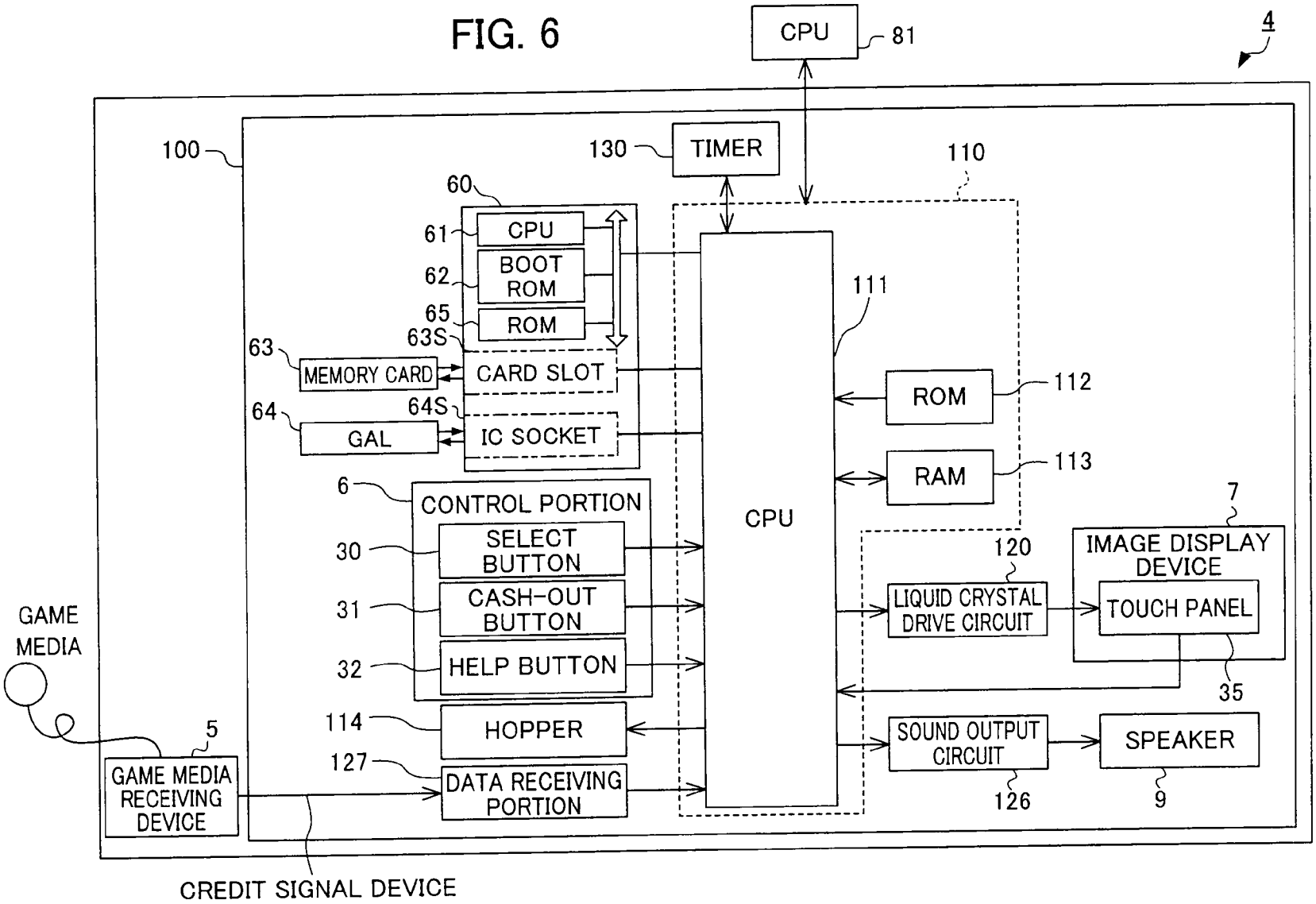
FIG. 6 is a block diagram showing an internal configuration of a station shown in FIG. 2.

FIG. 6 is a block diagram which shows the inside constitution of a station shown in FIG. 2.

The station 4 is provided with a body portion 100 in which the image display device 7 is provided, and a game media receiving device 5 installed in the body portion 100. Furthermore, the body portion 100 is provided with a station control portion 110 and a few pieces of peripheral equipment.

The station control portion 110 is provided with a CPU 111, ROM 112, and RAM 113.

The ROM 112 stores programs for implementing basic functions of the station 4, various programs necessary for control of the station 4, data tables, and the like.

The select button 30, cash out button 31, and help button 32 provided in the control portion 6 are each connected to the CPU 111. Furthermore, the CPU 111 controls the various corresponding operations that should be executed according to the operation signal output by pressing each button and the like. More specifically, various processing is executed based on an input signal supplied from the control portion 6 in response to an operation of a player having been input, as well as data and programs stored in the ROM 112 and RAM 113, and the result thereof is sent to the CPU 81 of the main control portion 80.

Furthermore, the CPU 111 receives command signals from the CPU 81 of the main control portion 80, and controls peripheral devices configuring the station 4. In addition, the CPU 111 executes various processing based on input signals supplied from the control portion 6 and touch panel 35, as well as data and programs stored in the ROM 112 and RAM 113. Then, the peripheral devices configuring the station 4 are controlled based on the results of the processing. It should be noted that, in regards to by which method processing is performed, it is set for each processing depending on the contents of this processing. For example, game media payout processing corresponds to the former, and BET operation processing by a player corresponds to the latter.

A hopper 114 is connected to the CPU 111, and the hopper 114 pays out a predetermined number of game media from the payout opening according to a command signal from the CPU 111.

The image display device 7 is connected to the CPU 111 via a liquid crystal drive circuit 120. The liquid crystal drive circuit 120 is configured with program ROM, image ROM, an image control CPU, work RAM, a VDP (video display processor), video RAM, and the like. Programs for image control related to display on the image display device 7, and various selection tables are stored in the program ROM. Dot data for forming images to be displayed by the image display device 7, for example, are stored in the image ROM. In addition, the image control CPU performs determination of an image to be displayed on the image display device 7 from among dot data stored beforehand in the image ROM, based on parameters set by the CPU 111, according to the image control program stored beforehand in the program ROM. Furthermore, the work RAM is configured as a temporary storage means for when the image control program is executed by the image control CPU. Moreover, the VDP forms an image according to display contents determined by the image control CPU, and performs output thereof to the image display device 7. It should be noted that the video RAM is configured as a temporary storage means for when an image is formed by the VDP.

Furthermore, a sound output circuit 126 and speaker 9 are connected to the CPU 111, and the speaker 9 generates various sound effects when performing various renderings based on output signals from the sound output circuit 126. In addition, a game media receiving device 5, which is a device that receives money and game media such as medals, is connected to the CPU 111 via a data receiving portion 127. The data receiving portion 127 receives a credit signal sent from the game media receiving device 5, and the CPU 111 adds a number of credits of a player stored in the RAM 113 based on the credit signal thus sent.

The timer 131, which is capable of measuring time, is connected to the CPU 111.

A gaming board 60 is provided with a CPU (Central Processing Unit) 61, ROM 65 and boot ROM 62, a card slot 63S compliant with a memory card 63, and an IC socket 64S compliant with GAL (Generic Array Logic) 64, which are mutually connected by an internal bus.

The memory card 63 consists of non-volatile memory such as compact flash (registered trademark), and stores a game program and a game system program.

In addition, the card slot 63S is configured so that the memory card 63 can be inserted thereinto, and is connected to the CPU 111 by an IDE bus. Therefore, it is also possible to change the type of game performed by the station 4 and contents by pulling the memory card 63 out from the card slot 63S, writing a different game program and game system program onto the memory card 63, and inserting this memory card 63 into the card slot 63S. In addition, it is possible to change the type of game performed by the station 4 and contents by replacing the memory card 63 on which one game program and game system program are stored with a memory card 63 on which a different game program and game system program are stored. A program related to game advancement and the like are included in the game program. In addition, image data, sound data and the like output during a game are included in the game program.

The GAL 64 is a type of PLD having an OR fixed array structure. The GAL 64 is provided with a plurality of input ports and output ports, and when predetermined data is input to an input port, data corresponding to this data is output from an output port. In addition, the IC socket 64S is configured so that the GAL 64 is detachable, and is connected to the CPU 111 by a PCI bus.

The CPU 61, ROM 65 and boot ROM 62, which are mutually connected by an internal bus, are connected to the CPU 111 by the PCI bus. The PCI bus performs signal transfer between the CPU 111 and the gaming board 60, and carries out electric power supply from the CPU 111 to the gaming board 60. Country identifying information and an authentication program are stored in the ROM 65. A preliminary authentication program, program (boot code) for the CPU 61 to start the preliminary authentication program, and the like are stored in the boot ROM 62.

The authentication program is a program (tamper checking program) for authenticating the game program and game system program. The authentication program is written in accordance with a sequence (authentication sequence) in which confirmation and verification that the game program and game system program, which are the targets of authentication processing, have not been tampered are performed, i.e. authentication of the game program and game system program. The preliminary authentication program is a program for authenticating the authentication program described above. The preliminary authentication program is written in accordance with a sequence (authentication sequence) in which verification that the authentication program, which is the target of authentication processing, has not been tampered is performed, i.e. authentication of the authentication program.

Next, processing executed in the main control unit 80 of the gaming system 1 according to the present embodiment is explained with reference to FIGS. 7 to 26.

Figure 7:
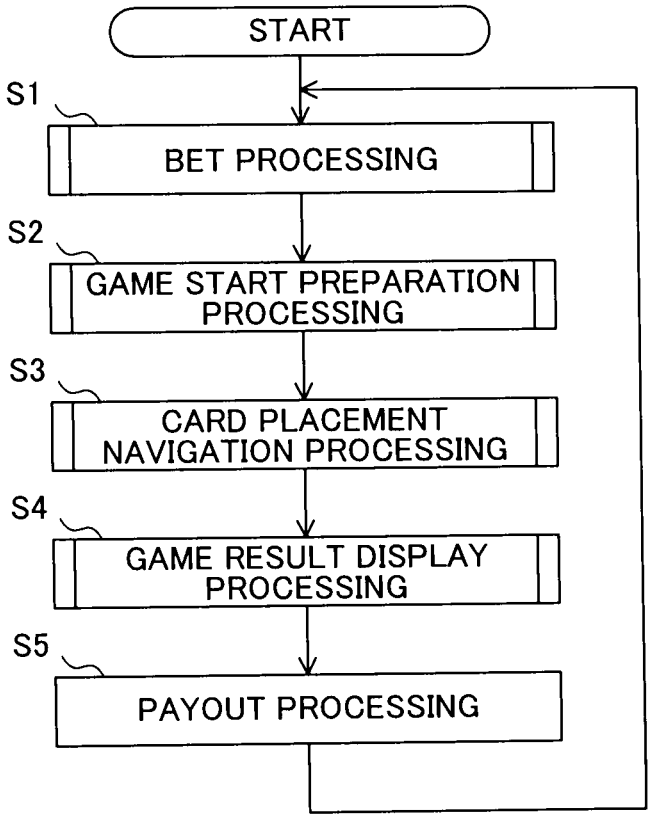
FIG. 7 is a flowchart of baccarat game execution processing according to the embodiment of the present invention.

First, baccarat game execution processing is described with reference to FIG. 7. FIG. 7 is a flowchart showing the baccarat game execution processing.

Figure 12:
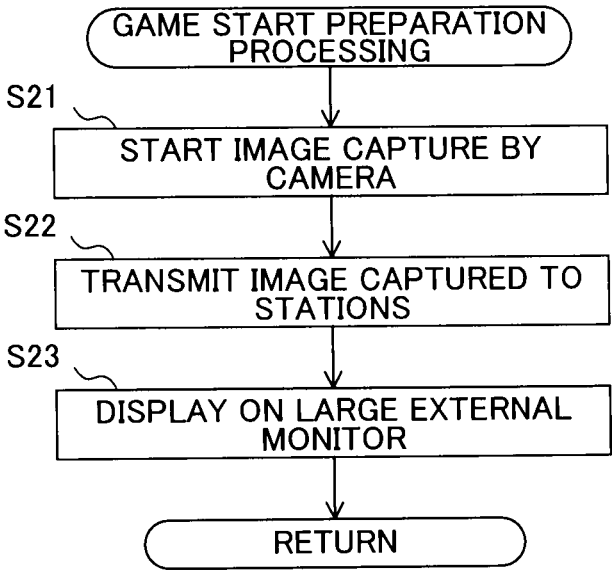
FIG. 12 is a flowchart of game start preparation processing according to the embodiment of the present invention.

First, in Step S1, the CPU 81 executes bet processing, which is described later in FIG. 8, and in Step S2, executes game start preparation processing, which is described later in FIG. 12. In addition, the CPU 81 executes card placement navigation processing, which is described later in FIG. 13, in Step S3. In Step S4, the CPU 81 executes game result display processing, which is described later in FIG. 24, and in Step S5, executes payout processing according to game results ("Player (player position) winning, "Banker (banker position) winning, or "Tie (draw)") and BET information sent from each station 4, and then returns to Step S1.

Figure 9:
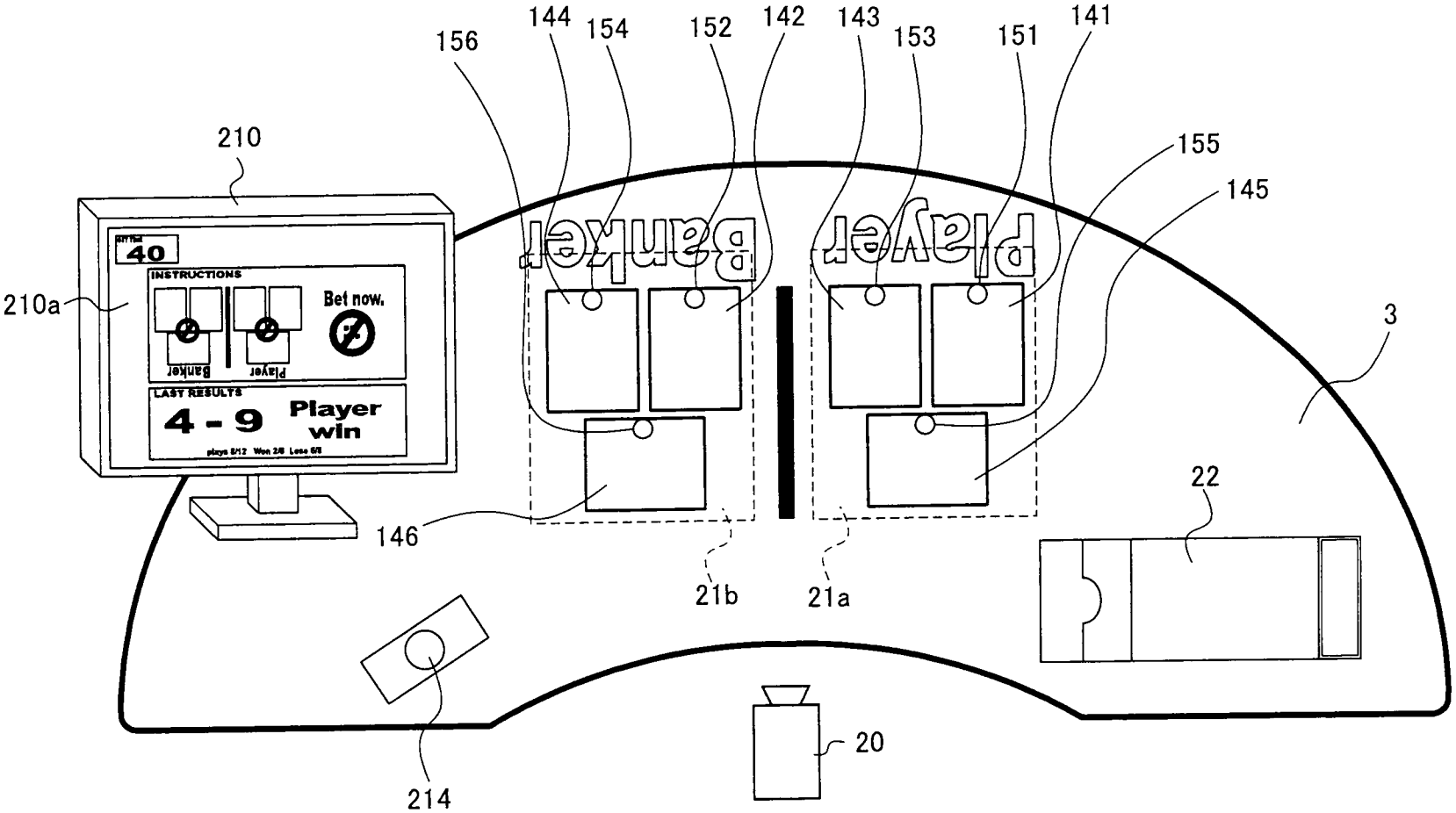
FIG. 9 is a view showing an appearance of the game portion according to the embodiment of the present invention.
Figure 10:
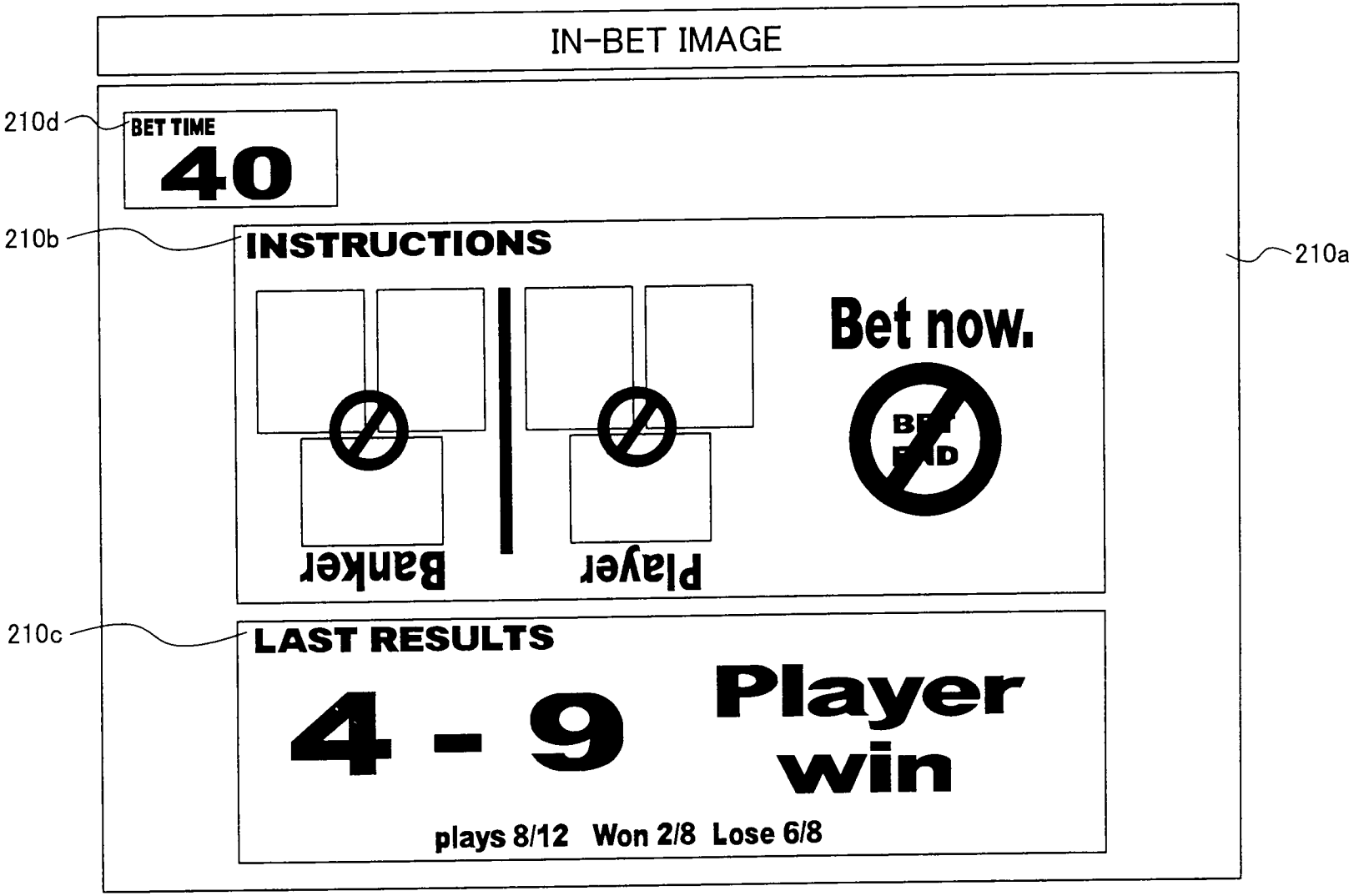
FIG. 10 is a view showing a display example of a dealer-used display according to the embodiment of the present invention.
Figure 11:
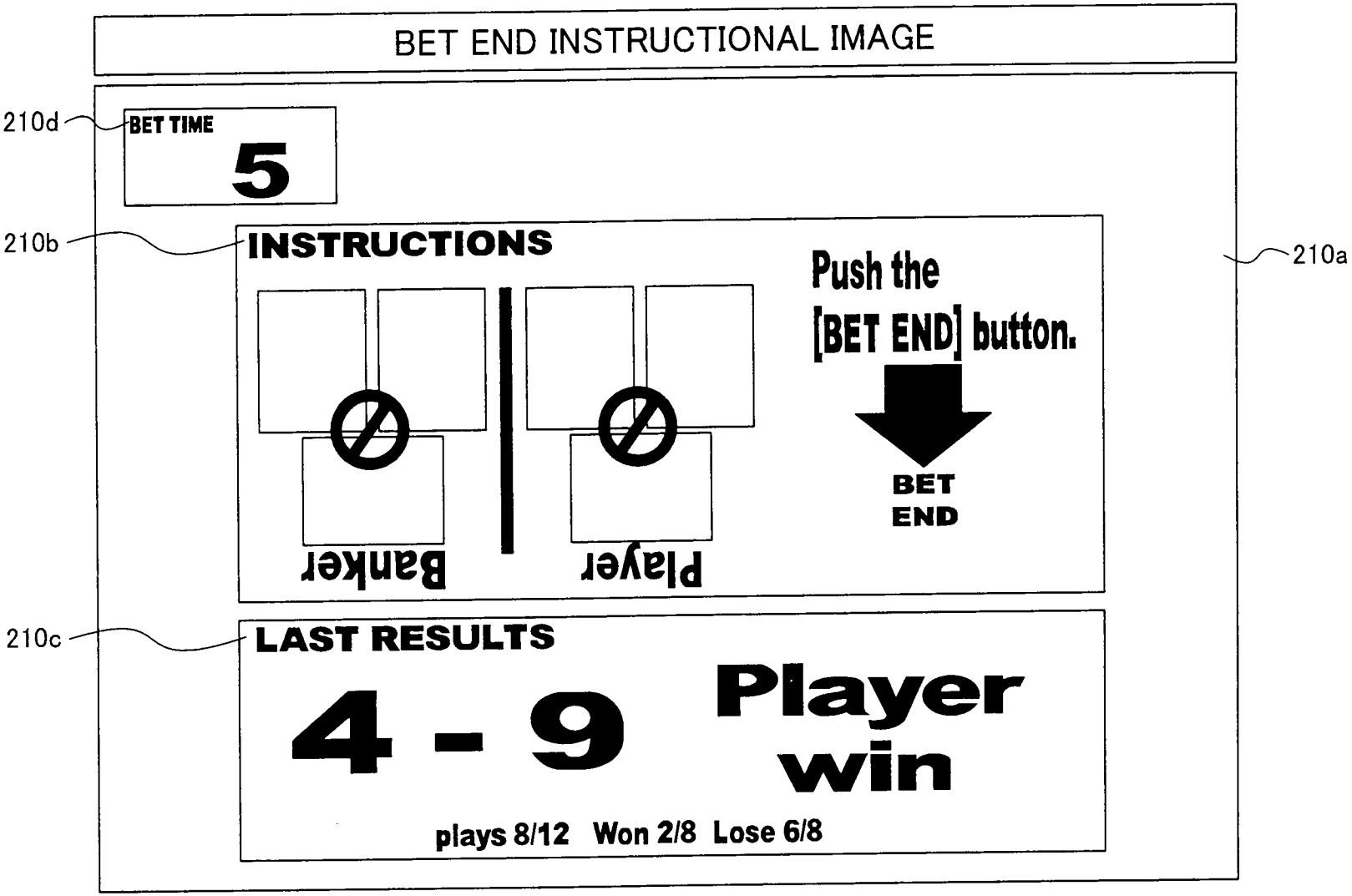
FIG. 11 is a view showing a display example of the dealer-used display according to the embodiment of the present invention.

Bet processing is explained with reference to FIGS. 8 to 11. FIG. 8 is a flow chart which shows bet processing. FIG. 9 is a diagram showing the game portion 3 during betting, FIG. 10 is a diagram showing a betting image of the dealer-used display 210, and FIG. 11 is a diagram showing a bet end instructional image of the dealer-used display 210.

In Step S11, the CPU 81 sends a bet start signal to each station 4. When a bet start signal has been received, betting is made possible at each station 4.

Here, an appearance during betting is explained with reference to FIGS. 9 and 10.

In FIG. 9, no cards have been placed on any of the card placement areas 141 to 146. The in-bet image shown in FIG. 10 is displayed on a display area 210*a* of the dealer-used display 210.

In the display area 210*b*, an image for navigating the dealer that the "BET END" button (operation input button 214) must not be pressed, is displayed in a display area 210*b*. An image showing the result of a previous game is displayed on the display area 210*c*. A time in which betting is possible is displayed in the display area 210*d*.

Referring again to FIG. 8, the CPU 81 determines whether or not a predetermined period of time has elapsed in Step S12. More specifically, the CPU 81 starts measuring an elapsed time t with the timer 131, compares the elapsed time t with data indicating a predetermined time period T1 (e.g., 5 seconds) stored in the ROM 82, and determines whether the elapsed time t measured by the timer 131 has become the predetermined time period T1. In a case of this determination being NO, the CPU 81 returns the processing to Step S12, and in the case of being YES, advances the processing to Step S13.

In Step S13, the CPU 81 displays the bet end instructional image (refer to FIG. 11) in the display area 210*a* of the dealer-used display 210.

Here, an appearance during betting is explained with reference to FIG. 11.

In the present embodiment, up until betting has ended, cards are not placed on any of the card placement areas 141 to 146. Therefore, the same as in FIG. 9, cards are not placed on any of the card placement areas 141 to 146 due to being during betting. Then, when an elapsed time t measured by the timer 131 approaches a predetermined time period T1 for betting, the bet end instructional image is displayed in the display area 210*a* of the dealer-used display 210, as shown in FIG. 11.

FIG. 11 is a view showing the bet end instructional image, and the image for navigating the dealer that the "BET END" button (operation input button 214) should be pressed is displayed in the display area 210*b*. An image showing the result of a previous game is displayed on the display area 210*c*. A remaining time in which betting is possible is displayed in the display area 210*d*. Herein, the bet end instructional image is displayed when 5 seconds remain. More specifically, display is made indicating to "Push the 'BET END' button", which instructs to press an operation input button 214 on the display area 210*b* to end betting.

Figure 8:
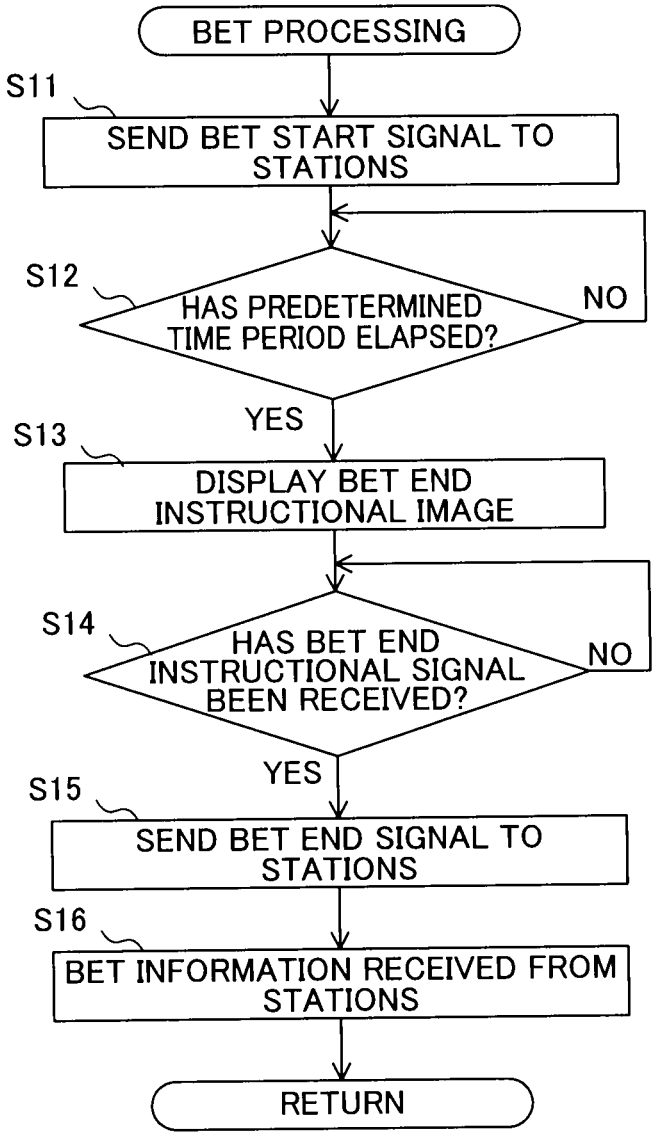
FIG. 8 is a flowchart showing bet processing according to the embodiment of the present invention.

In Step S14 of FIG. 8, the CPU 81 determines whether or not the bet end instruction signal has been received from the operation input button 214. In the case of this determination being NO, the CPU 81 returns the processing to Step S14, and in the case of being YES, advances the processing to Step S15.

In Step S15, the CPU 81 sends a bet end signal to each station 4. When the bet end signal has been received at each station 4, betting becomes impossible, and the CPU 111 in the station control portion 110 displays an image (not illustrated) informing that acceptance of bets has ended on the image display device 7.

In Step S16, the CPU 81 receives BET information from each station 4. BET information is information related to a BET input performed at each station 4. In addition, information indicating whether a bet stored in a bet presence determination table (not illustrated) has been performed is also included in the BET information. When the processing of Step S16 ends, the CPU 81 ends bet processing.

Even if the dealer is inexperienced, an end operation for bet acceptance can be performed according to an instructional image by way of the bet processing of the present invention.

Game start preparation processing is explained with reference to FIG. 12. FIG. 12 is a flowchart showing game start preparation processing.

In Step S21, the CPU 81 starts image capturing with the camera 20, and displays an image captured by the camera 20 on the image display device 7 of the stations 4 by transmitting to the stations 4 simultaneously (Step S22). From this it is possible for players to confirm actions of the dealer and advancement of the game from the stations 4.

In addition, in Step S23, the CPU 81 causes images captured by the camera 20 to be simultaneously displayed on the large external monitor 500 as well. From this it is possible not only for a player operating a station 4, but also the gallery to confirm aspects of the game. Thereafter, aspects of the game performed at the game portion 3 are relayed to the stations 4 and the large external monitor 500.

Figure 13:
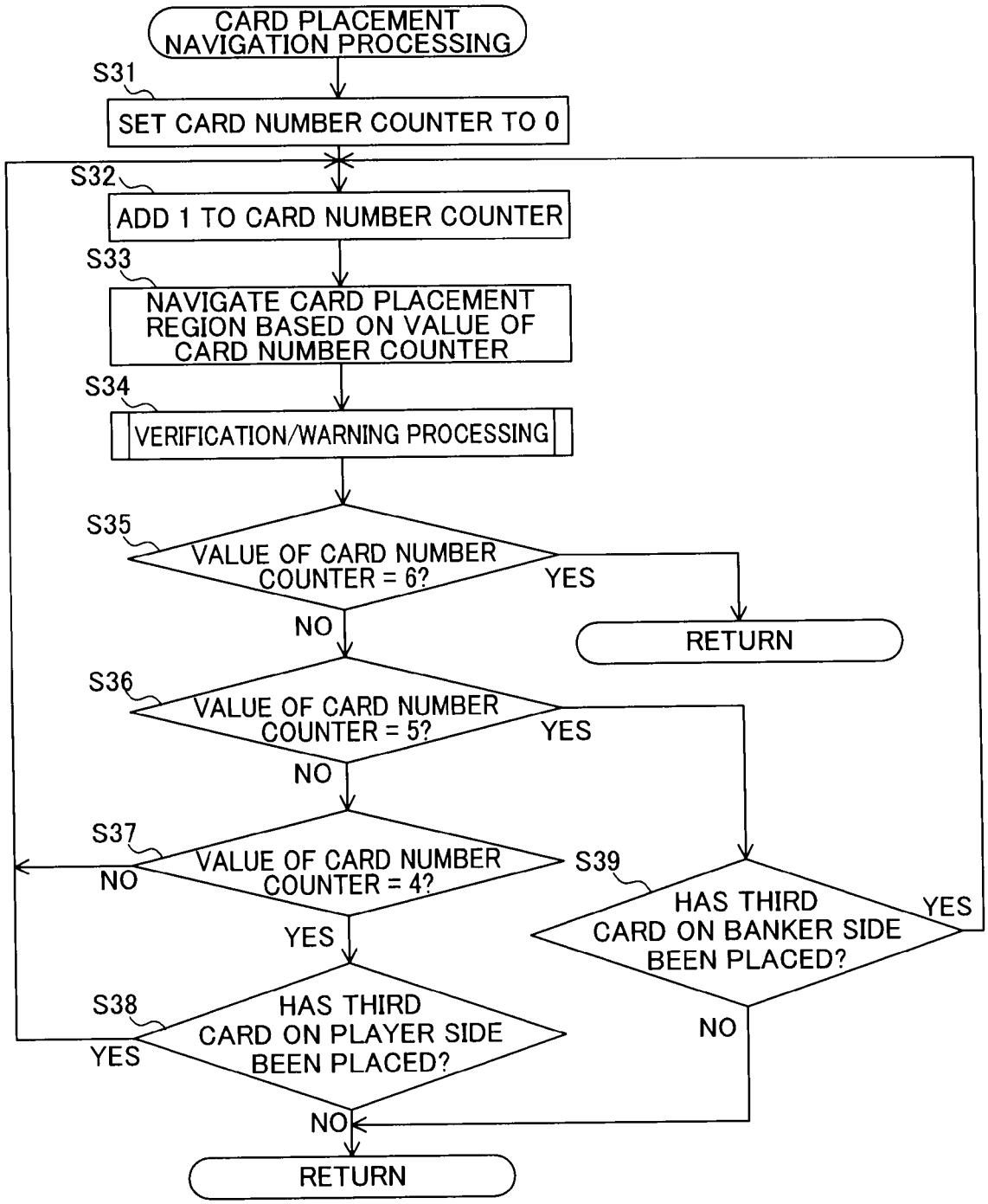
FIG. 13 is a flowchart of card placement navigation processing according to the embodiment of the present invention.
Figure 14:
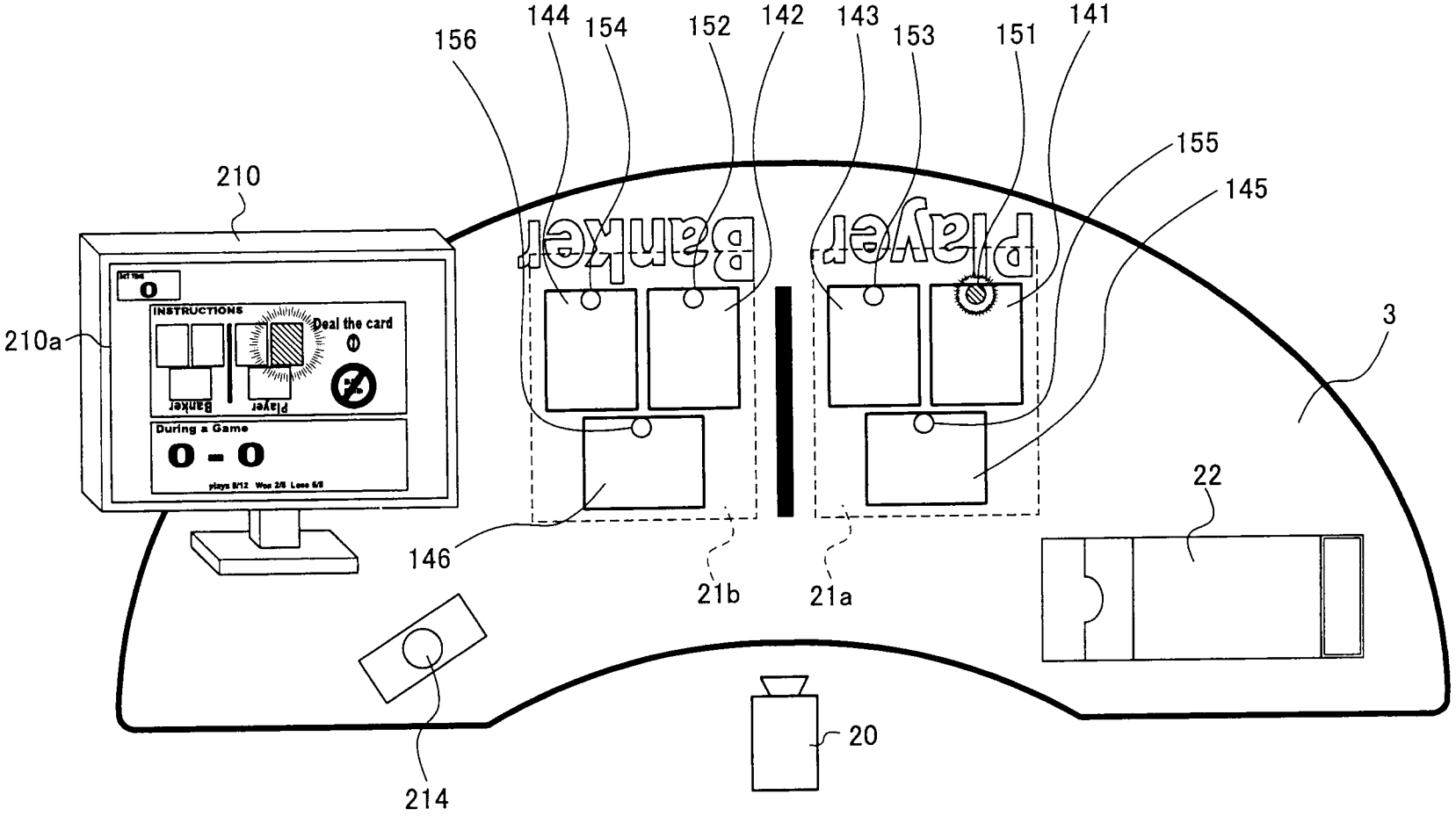
FIG. 14 is a view showing an appearance of the game portion according to the embodiment of the present invention.
Figure 15:
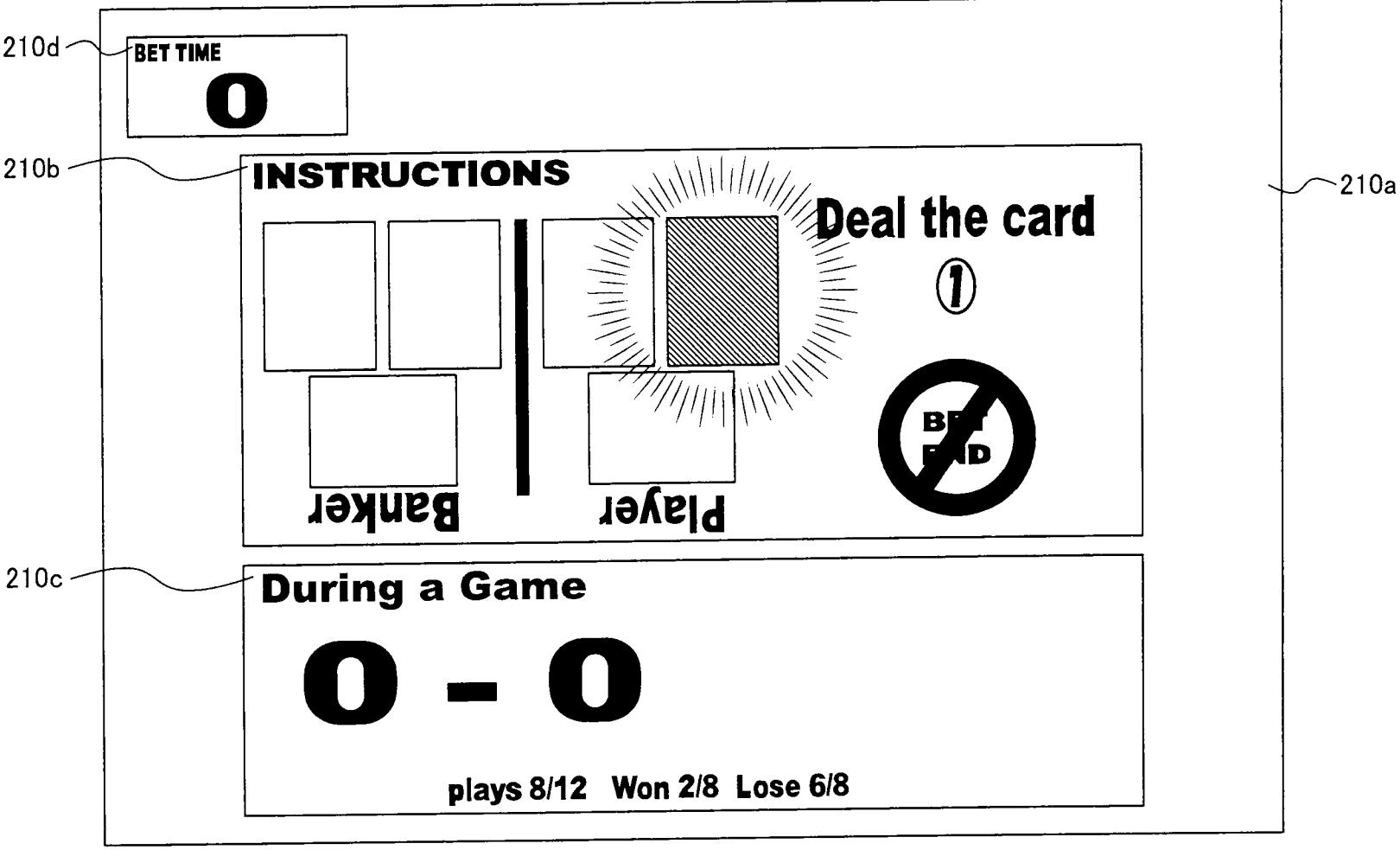
FIG. 15 is a view showing a display example of a dealer-used display according to the embodiment of the present invention.
Figure 16:
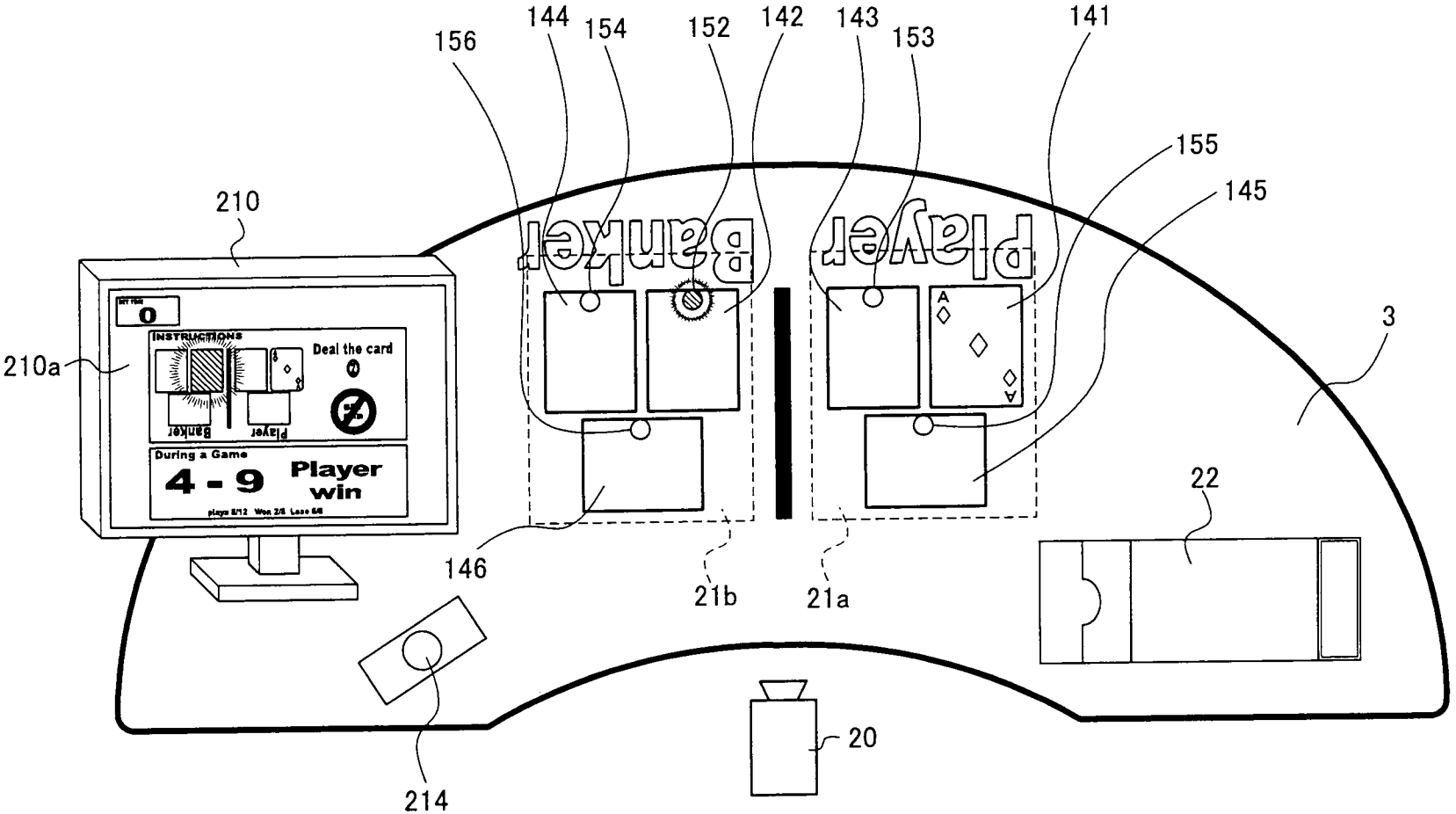
FIG. 16 is a view showing an appearance of the game portion according to the embodiment of the present invention.
Figure 17:
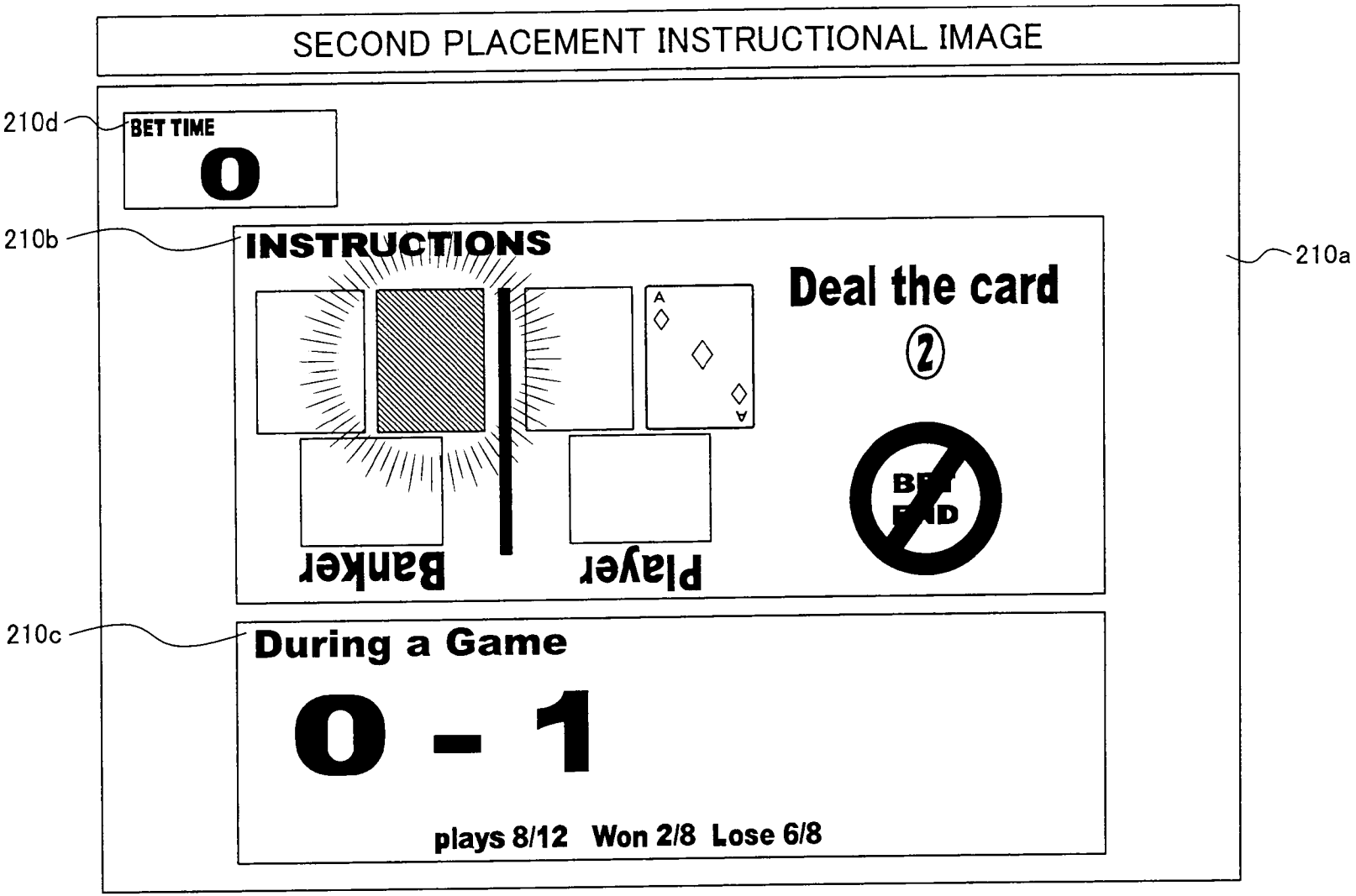
FIG. 17 is a view showing a display example of a dealer-used display according to the embodiment of the present invention.
Figure 18:
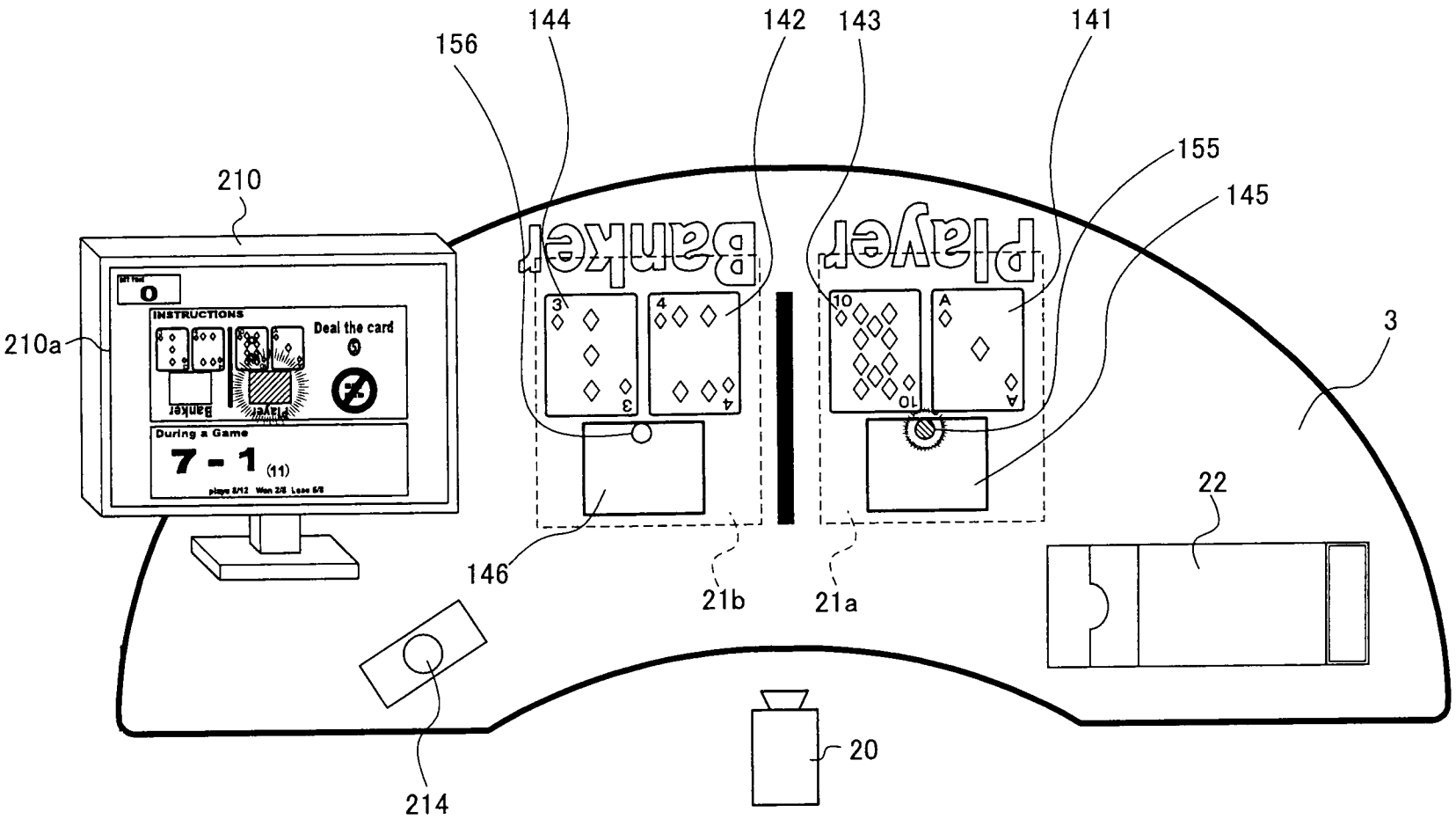
FIG. 18 is a view showing an appearance of the game portion according to the embodiment of the present invention.
Figure 19:
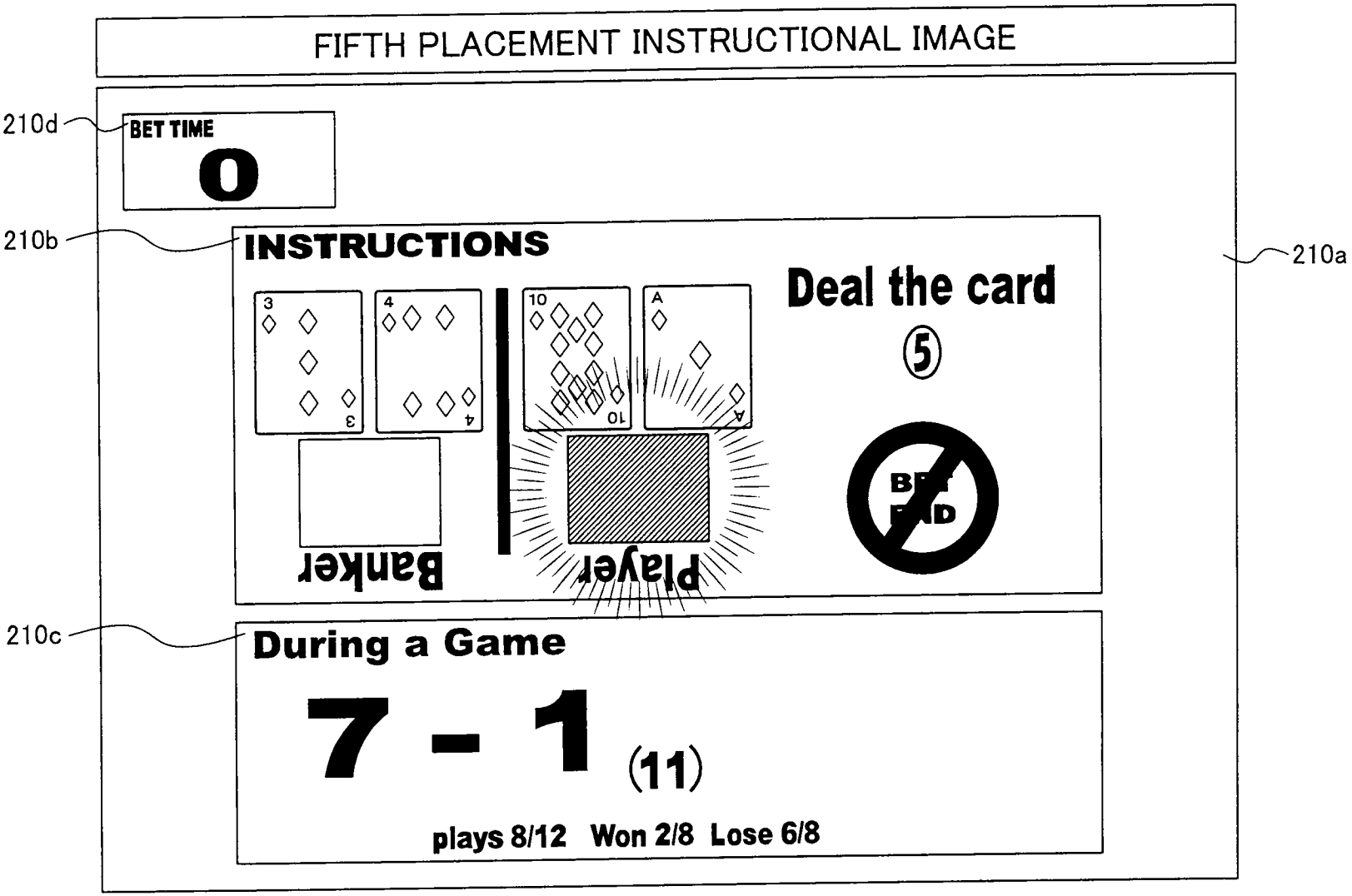
FIG. 19 is a view showing a display example of a dealer-used display according to the embodiment of the present invention.

The card placement navigation processing is explained with reference to FIGS. 13 to 19. FIG. 13 is a flowchart showing the card placement navigation processing. FIG. 14 is a view showing an appearance of the game portion 3 during placement of a first card in the card placement area 141. FIG. 15 is a view showing a first card placement instructional image displayed on the dealer-used display 210. FIG. 16 is a view showing an appearance of the game portion 3 during placement of a second card in the card placement area 144. FIG. 17 is a view showing a second card placement instructional image displayed on the dealer-used display 210. FIG. 18 is a view showing an appearance of the game portion 3 during placement of a fifth card in the card placement area 145. FIG. 19 is a view showing a fifth card placement instructional image displayed on the dealer-used display 210.

In Step S31, the CPU 81 sets the card number counter to 0. This card number counter is a counter for counting the number of cards positioned on the card placement areas 141 to 146, and is provided in a predetermined memory area of the RAM 83.

Here, a relationship between the number of cards and the card placement areas 141 to 146 is explained.

A first card is placed on the card placement area 141 of the player side. A second card is placed in the card placement area 142 of the banker side. A third card is placed in the card placement area 143 of the player side. A fourth card is placed in the card placement area 144 of the banker side. A fifth card is placed in the card placement area 145 of the player side. A sixth card is placed in the card placement area 146 of the banker side. In this way, since the position at which the dealer places cards changes according to advancement of the game, the dealer is navigated of the position to place a card according to the value indicated by the card number counter.

In Step S32, the CPU 81 adds 1 to the card number counter, and advances to Step S33.

In Step S33, the CPU 81 navigates of the card placement areas 141 to 146 on which a card should be placed based on the value of the card number counter.

Here, an aspect of navigating the placement area of a first card is explained with reference to FIGS. 14 and 15.

FIG. 14 is a view showing an appearance of the game portion 3 while navigation of a placement area of a first card is being performed when the value of the card number counter is 1. According to FIG. 15, the lamp 151 provided at the card placement area 141 is illuminated in green. A first placement instructional image shown in FIG. 15 is displayed on the display area 210*a* of the dealer-used display 210.

In this way, the dealer can recognize that a card should be placed on the card placement area 141.

FIG. 15 is a view showing a first placement instructional image, and the image for navigating the dealer that the first card should be placed on the card placement area 141 is displayed in the display area 210*b*. According to this figure, the location corresponding to the card placement area 141 is shown to be illuminated in green. An image showing the result of a previous game is displayed on the display area 210*c*. The facts that the time in which betting is possible is 0, and that the betting period has ended are shown in the display area 210*d*.

In this way, the dealer can recognize that the card should be placed on the card placement area 141 also by looking at the display area 210*b*.

Furthermore, an aspect of navigating the placement area of a second card is explained with reference to FIGS. 16 and 17.

FIG. 16 is a view showing an appearance of the game portion 3 while navigation of a placement area of the second card is being performed when the value of the card number counter is 2. According to FIG. 16, the first card is placed on the card placement area 141, and the lamp 152 provided at the card placement area 142 is illuminated in green. A second placement instructional image, shown in FIG. 17, is displayed in the display area 210*a* of the dealer-used display 210.

In this way, the dealer can recognize that the card should be placed on the card placement area 142.

FIG. 17 is a view showing a second placement instructional image, and the image for navigating the dealer that the second card should be placed on the card placement area 142 is displayed in the display area 210*b*. According to this figure, a location corresponding to the card placement area 142 is shown to be illuminated in green. In the display area 210*c*, an image showing a current score is displayed. An Ace of diamonds is placed on the player side and no card is placed on the banker side, and thus a score "0-1" is displayed. Here, the score is calculated based on rules of the game executed in the gaming system 1. More specifically, the score is calculated based on the game advancement program stored in the ROM 82. In the present embodiment, the gaming system 1 is a system for executing a baccarat game. Accordingly, based on the game advancement program, Ace is 1 point, face cards (J, Q and K) are each 10 points, and the other cards (2 to 9) are 2 to 9 points, respectively. The banker side or the player side having cards placed in the respective card placement areas 141 to 146 having a total is closer to 9, is the winner. It should be noted that, in a case where the total exceeds 10, the tens digit is not used in the score. The facts that the time in which betting is possible is 0, and that the betting period has ended are shown in the display area 210*d*.

In this way, the dealer can recognize that the card should be placed on the card placement area 142 also by looking at the display area 210*b*.

It should be noted that the method of navigating a placement area of a third or higher card is also the same as the method shown in FIGS. 14 to 17.

Again referring to FIG. 13, in Step S34, the CPU 81 performs verification/warning processing. The warning processing is described later with reference to FIG. 18.

In Step S35, the CPU 81 determines whether the value of the card number counter is 6. In a case of this determination being YES, the CPU 81 ends the card placement navigation processing, and in the case of being NO, advances the processing to Step S36.

In Step S36, it is determined whether the value of the card number counter is 5. In the case of this determination being YES, the CPU 81 advances the processing to Step S39, and in the case of being NO, advances the processing to Step S37.

In Step S37, it is determined whether the value of the card number counter is 4. In the case of this determination being YES, the CPU 81 advances the processing to Step S38, and in the case of being NO, advances the processing to Step S32.

In Step S38, the CPU 81 determines whether a third card of the player side has been placed. In the case of this determination being YES, the CPU 81 advances the processing to Step S32, and in the case of being NO, ends the card placement navigation processing. More specifically, the CPU 81 determines whether the third card of the player side has been placed based on information of the first to fourth cards (first of the player side, first of the banker side, second of the player side, and second of the banker side), stored in a predetermined memory area of the RAM 83.

Here, an aspect of navigating the placement area in the case of placing a third card on the player side is explained with reference to FIGS. 18 and 19.

FIG. 18 is a view showing an appearance of the game portion 3 while navigation of a placement area of a third card of the player side (a fifth card in total) is being performed when the value of the card number counter is 1. According to FIG. 18, the lamp 155 provided at the card placement area 145 is illuminated in green. A fifth placement instructional image shown in FIG. 19 is displayed on the display area 210*a* of the dealer-used display 210.

In this way, the dealer can recognize that a card should be placed on the card placement area 145.

FIG. 19 is a view showing a fifth placement instructional image, and the image for navigating the dealer that the fifth card should be placed on the card placement area 145 is displayed in the display area 210*b*. According to this figure, the location corresponding to the card placement area 145 is shown to be illuminated in green. In the display area 210*c*, a current score is displayed. The score of the player side is "1 (11)", and the score of the banker side is "7". "1 (11)" means that the score is "1" and the total value of the card is "11". Cards of "1" and "10" are placed in the card placement areas 141 and 143 on the player side, thus making the total "11". However, due to being 10 or greater, only the ones digit thereof, "1", is the score. The facts that the time in which betting is possible is 0, and that the betting period has ended are shown in the display area 210*d*.

In this way, the dealer can recognize that the card should be placed on the card placement area 141 also by looking at the display area 210*b*.

In Step S39, the CPU 81 determines whether the third card of the banker side has been placed. In the case of this determination being YES, the CPU 81 advances the processing to Step S32, and in the case of being NO, ends card placement navigation processing. More specifically, the CPU 81 determines whether the third card of the banker side has been placed based on information of the first to fifth cards (first of the player side, first of the banker side, second of the player side, second of the banker side, third of the player side), stored in a predetermined memory area of the RAM 83.

Figure 20:
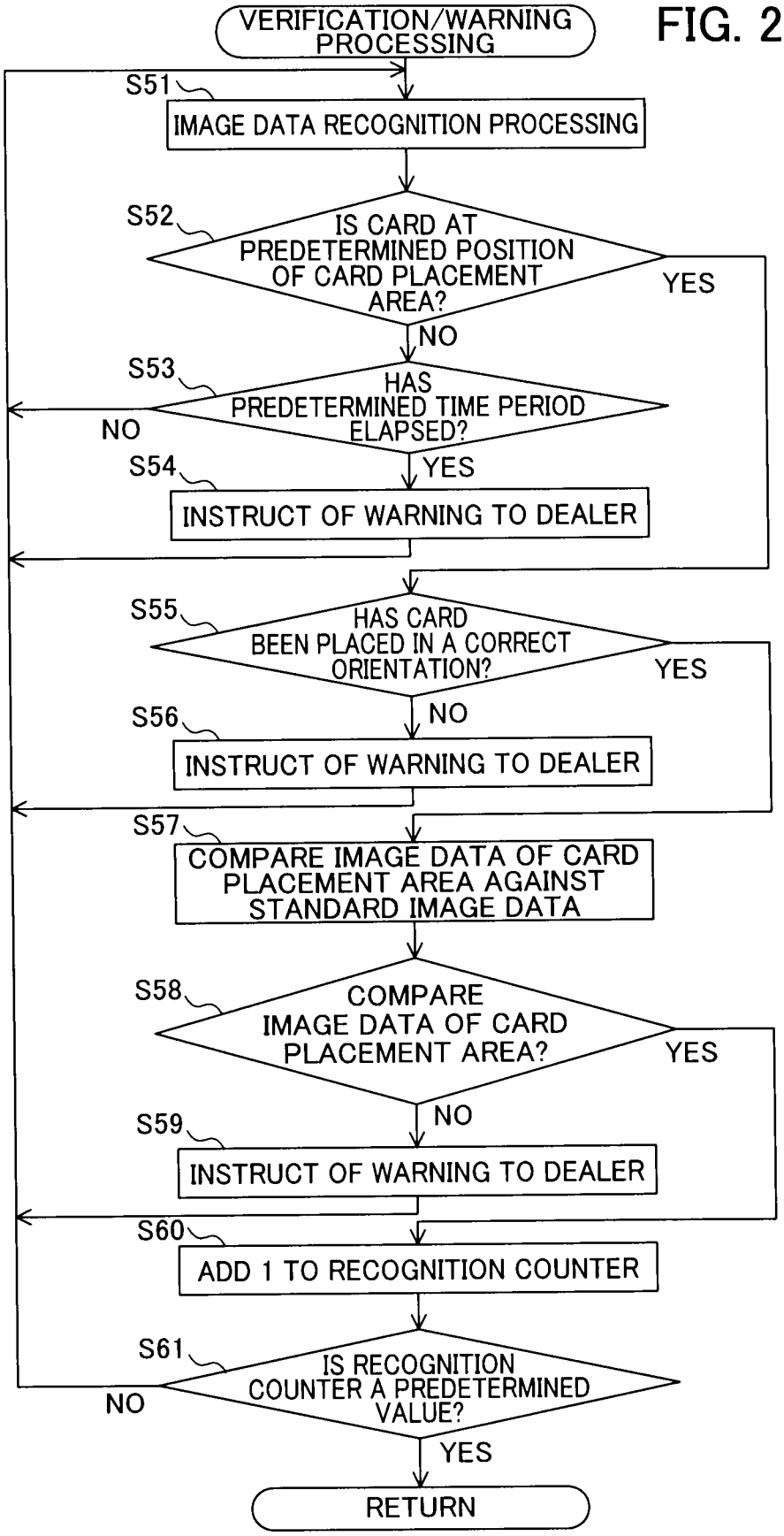
FIG. 20 is a flowchart of verification/warning processing according to the embodiment of the present invention.
Figure 21:
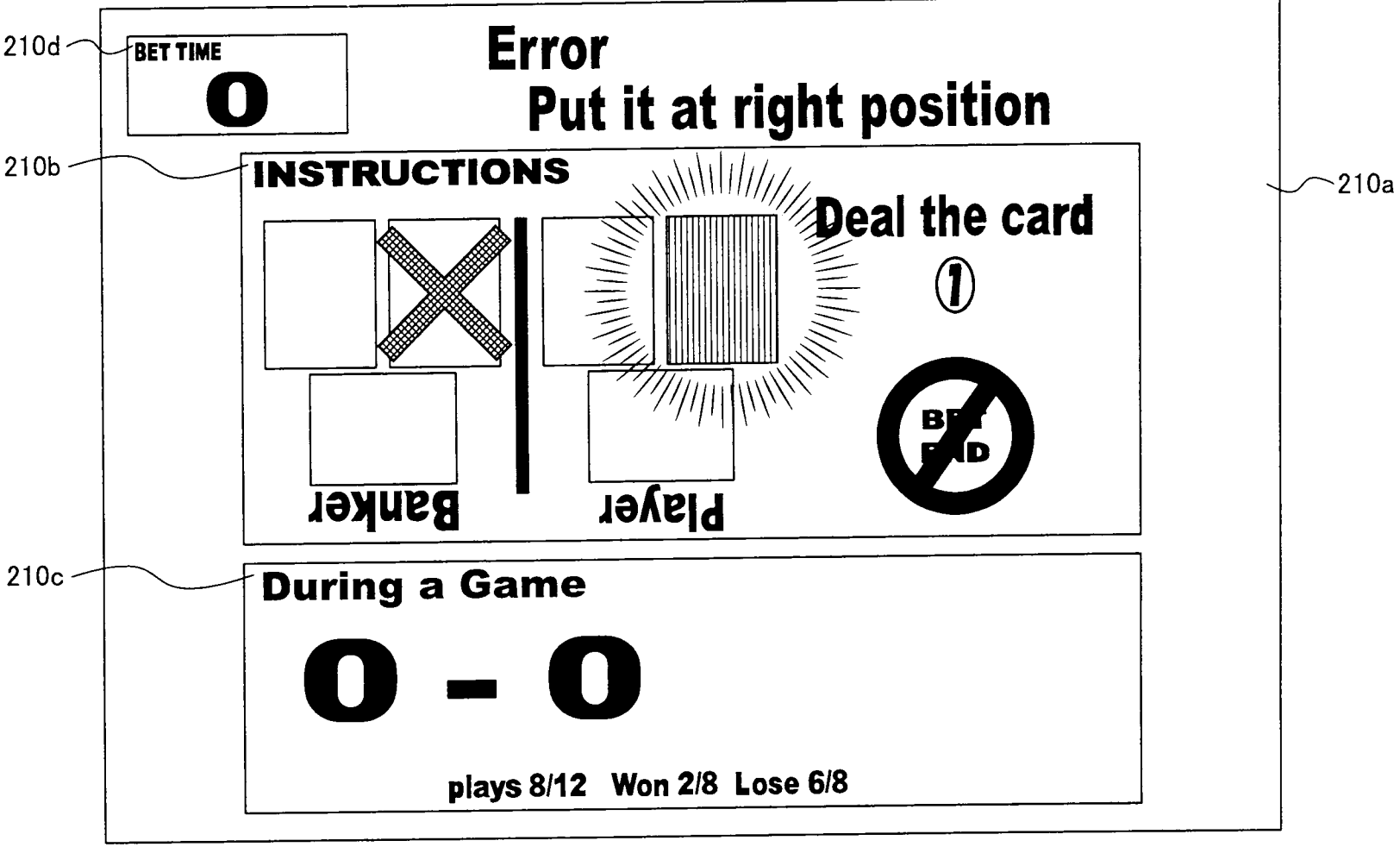
FIG. 21 is a view showing a display example of a dealer-used display according to the embodiment of the present invention.
Figure 22:
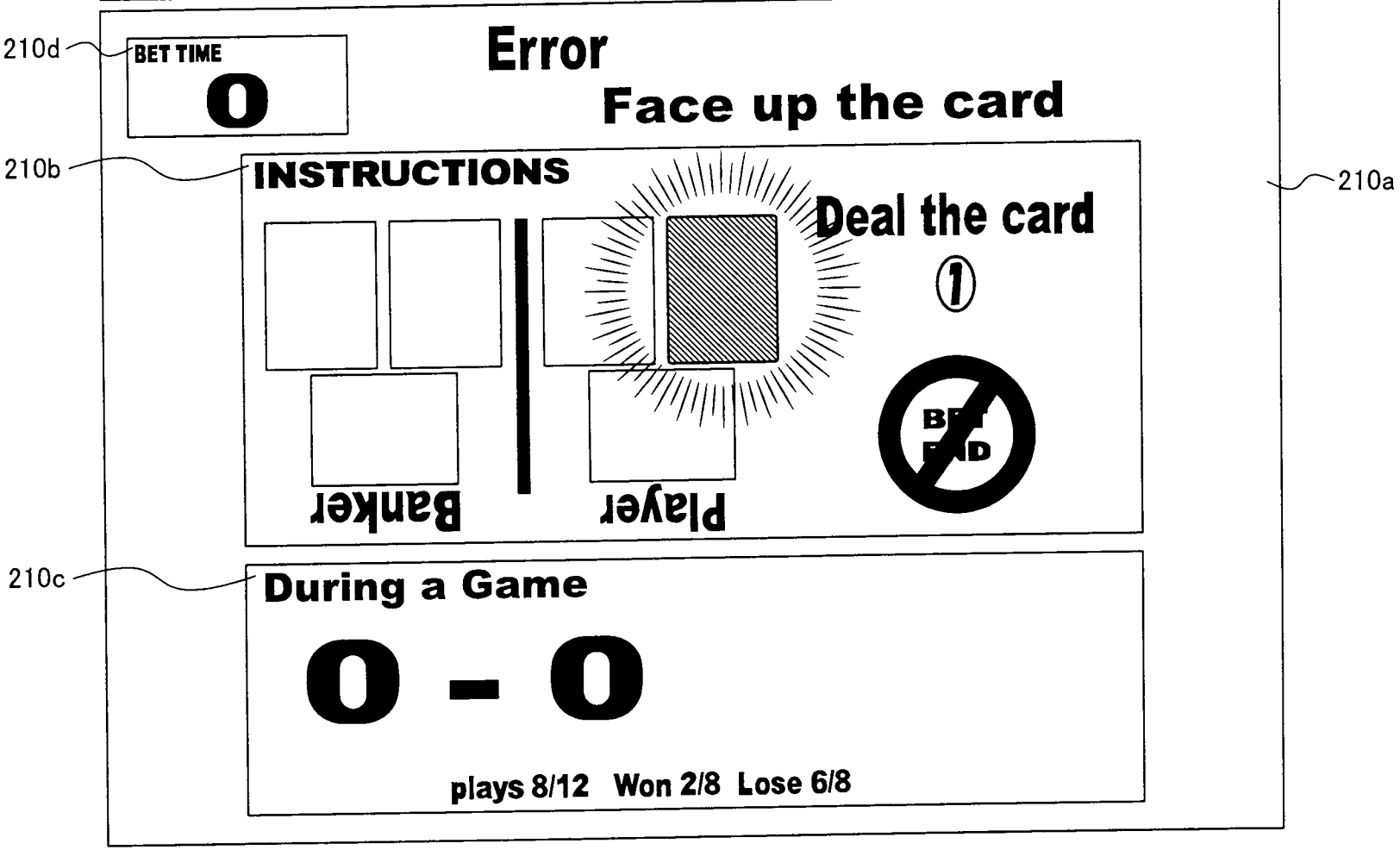
FIG. 22 is a view showing a display example of a dealer-used display according to the embodiment of the present invention.
Figure 23:
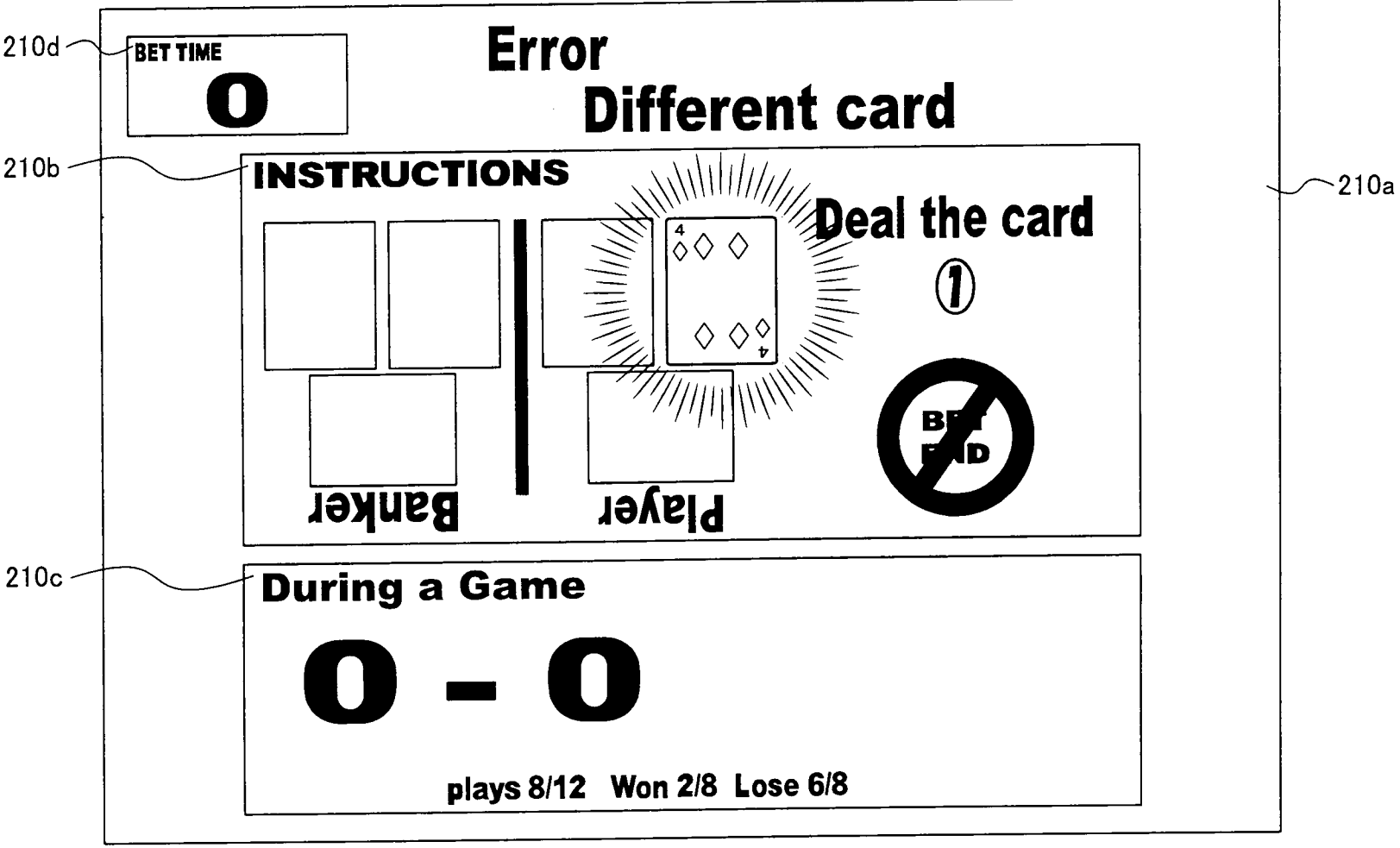
FIG. 23 is a view showing a display example of a dealer-used display according to the embodiment of the present invention.

Verification/warning processing is explained with reference to FIGS. 20 to 23. FIG. 20 is a flowchart showing verification/warning processing. FIG. 21 is a view showing an instructional image warning of an incorrect position of a card being placed, FIG. 22 is a view showing an instructional image warning of incorrect orientation of the card being placed, and FIG. 23 is an instructional image warning of an incorrect card being placed.

In Step S51, the CPU 81 performs image data recognition processing based on image data captured by the camera 20. This processing is performed in the CPU 81, and first determines whether a card has been placed on any of the card placement areas 141 to 146. This determination compares, in a unit frame, image data captured in real-time by the camera 20 with standard image data having captured the card placement areas 141 to 146 in a state in which no cards have been placed thereon. More specifically, for image data captured by the camera 20, each area portion of the card placement areas 141 to 146 is recognized, and each of these area portions is compared with each area portion of the card placement areas 141 to 146 in the standard image data. Then, in a case in which there is an image showing a card in any of the card placement areas 141 to 146 among the image data captured by the camera 20, since this would differ from the standard image data, it is recognized that a card has been placed. Next, the value and classification of suit of the card thus positioned is recognized by way of pattern recognition. Then, this frame of image data thus recognized and information of the card thus recognized are associated with a value of the card number counter, and stored in a predetermined memory area of the RAM 83. As a result, in a case in which the first card (card that is read first, and card that is placed on the card placement area 141) is the 6 of diamonds, data containing "1, diamonds, 6" is stored in a predetermined memory area of the RAM 83, for example. Then, these frames and information are used in the following steps. In addition, the frames of a state in which a card has been placed are temporarily stored in the RAM 83 as standard image data for when a next card has been placed, and employed in processing when the next card has been placed.

In Step S52, the CPU 81 determines whether a card has been placed at a predetermined position within a predetermined time period. More specifically, the CPU 81 determines whether a card is placed at a position designated in a game advancement program, based on a game advancement program stored in the ROM 82 and image data captured by the camera 20 (specifically, a frame of image data employed in Step S51). Furthermore, the CPU 81 verifies the image data received and standard image data of the card placement areas 141 to 146 of a state in which no cards have been placed thereon, and in a case in which the image data thus received is different from the image data before the start of the game, and an image is included that shows a card at a position at which it should be placed in the game advancement program, the CPU 81 determines that a card has been placed. In the case of a YES determination, the CPU 81 advances the processing to Step S55, and in a case of a NO determination, advances the processing to Step S53.

In Step S53, the CPU 81 determines whether a predetermined time period has elapsed. More specifically, the CPU 81 determines whether a time measured by the timer 131 has passed a predetermined time period since the previous processing. Previous processing, for example, can exemplify processing that cuts off betting (for example, Step S15 described above) or previous navigation processing (for example, Step S34 described above). In the case of the predetermined time period having elapsed (in the case of YES in Step S52), Step S54 is advanced to, and in the case of the predetermined time period not having elapsed (in the case of NO in Step S52), Step S51 is returned to.

In Step S54, the CPU 81 performs warning notification to the dealer. More specifically, the CPU 81 displays on the dealer-used display 210 a warning indicating that a card has not been placed at a predetermined position. Placing the first card is described as an example. In this case, since the value of the card number counter is 1, a card is to be placed in the card placement area 141. Accordingly, the CPU 81 illuminates the lamp 151, which corresponds to the card placement area 141, in red. In this way, even in a case where the first card has not been placed on the card placement area 141 within the predetermined time period, by changing from green and illuminating the lamp in red, the dealer can understand that a card must be placed on the card placement area 141. In a case of the value of the card number counter being 2 to 6, one of the lamps 152 to 156 is illuminated in red. It should be noted that it is not limited to being illuminated in red, and may be configured so as to blink in red.

Here, an aspect of performing warning notification of a placement area of the first card is explained with reference to FIG. 21.

FIG. 21 is a view showing a first card placement warning image. In the display area 210*a*, a warning of an incorrect position of the card is displayed. An image notifying a warning to the dealer that the first card should be placed in the card placement area 141 is displayed in the display area 210*b*. According to FIG. 21, the location corresponding to the card placement area 141 is shown to be illuminated in red. In addition, "X" is displayed in the card placement area 143. This indicates that a card is not to be placed in the card placement area 143 since an image representing a card is present in the card placement area 143. An image showing the result of a previous game is displayed on the display area 210*c*. The facts that the time in which betting is possible is 0, and that the betting period has ended are shown in the display area 210*d*. Here, for example, in a case where no cards have been placed at all, the warning displayed in the display area 210*a* can indicate that no cards have been placed at all, or that a card is to be placed in the card placement area 141.

Referring again to FIG. 20, in Step S55, the CPU 81 determines whether the orientation in which the card has been placed is the correct orientation. More specifically, the CPU 81 determines whether an upper face of the card is a correct face, based on the game advancement program stored in the ROM 82 and the image data received from the camera 20. In the present embodiment, the cards are set with all obverse faces as facing up. Therefore, the CPU 81 determines whether a face on which a numeral or a symbol of the card is marked is included in the image data. Alternatively, determination of whether or not a reverse face of the card is included in the image data received from the scanners 21*a* and 21*b* can be made. In the case of the orientation in which the card is placed being determined to be the correct orientation (in the case of YES in Step S55), the CPU 81 advances to Step S57, and in the case of being determined to not be the correct orientation (in the case of NO in Step S55), the CPU 81 advances to Step S56.

In Step S56, the CPU 81 performs warning display on the dealer-used display 210. More specifically, as shown in FIG. 22, a warning indicating that the obverse face of the card should be placed facing up is displayed in display portion 210*a*, for example, the card placement area corresponding on the screen (card placement area 141 in FIG. 22) is illuminated in red.

In Step S58, the CPU 81 compares the image data of a state in which a card is newly placed in a card placement area 141 to 146 with standard image data. More specifically, the CPU 81 compares an image contained among image data thus received and indicating a card that has been newly place in a card placement area 141 to 146 with standard image data of cards stored in the RAM 83. Particularly, the CPU 81 recognizes image data received from the scanners 21*a* and 21*b*. In the present embodiment, since the card is placed face-up, the scanners 21*a* and 21*b* capture image data of a reverse face of the card, and sends the image data to the control unit 2. First, the CPU 81 compares the reverse face of the card against the standard image data. A pattern on the reverse face of the card is the same for all the cards in a deck, and different between decks. Therefore, by identifying the pattern on the reverse face of the card, data for the obverse face thereof can be retrieved.

Next, the CPU 81 retrieves the standard image data for the obverse face of the card from the RAM 83, and determines whether or not the image indicating the card recognized in Step S51 shows the same card as the standard image data. The standard image data for the obverse face of the card is stored in the RAM 83 for all cards included in a deck. Therefore, the CPU 81 compares the standard image data of obverse faces retrieved by identifying the reverse faces with each of the images showing a card recognized in Step S57, and determines whether the same cards are respectively shown by pattern recognition. In the case of the card being the same as the image in the plurality of standard image data representing the card recognized in Step S57 (in the case of YES in Step S58), the CPU 81 advances to Step S60, and in the case of being determined not to be the same card (in the case of NO in Step S58), the CPU 81 advances to Step 59.

In Step S59, the CPU 81 performs a warning display indicating that a card different from the standard image data has been placed. In this warning, a similar image to the warning display shown in FIG. 23 is displayed on the dealer-used display 210. When this processing ends, the CPU 81 advances to Step S60.

The warning display displayed on the dealer-used display 210 in Step S57 is explained hereinafter with reference to FIG. 23. The warning display shown in FIG. 23 shows a case in which a warning has been performed during placement of a first card. A message indicating the fact that a different card has been placed is displayed on the upper side of the display area 210*b* in the display area 210*a*. This shows that a card not contained in the standard image data has been placed. In addition, in the display area 210*b*, an image warning a dealer that the first card should be placed in the card placement area 141. This diagram shows that a location corresponding to the card placement area 141 is illuminated in red and the card placed in the area is the 4 of diamonds. Since the placement of cards has started, the present game is in progress. Therefore, in the display area 210*c*, an image showing a current score is displayed.

In Step S60, the CPU 81 adds 1 to a recognition counter stored in the RAM 83. This recognition counter is a counter that counts a number of times the verification/warning processing (Step S51 to Step S59) has been performed. In the present embodiment, Step S51 to Step S59 described above are performed a predetermined number of times. This allows for false recognition of a card to be prevented.

In Step S61, the CPU 81 determines whether the recognition counter is a predetermined value. This predetermined value can be arbitrarily set by a manager of a gaming facility to "3" or "5", for example. In a case where the predetermined value is "3", verification/warning processing will be performed 3 times. In addition, in the case of being the predetermined value, the recognition counter is set to 0, verification/warning processing is ended, and the processing advances to Step S37 of FIG. 13.

Figure 24:
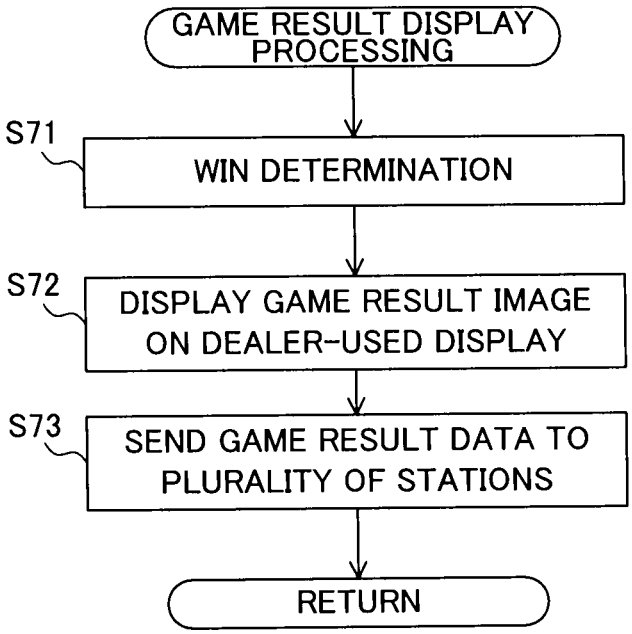
FIG. 24 is a flowchart showing game result display processing according to the embodiment of the present invention.
Figure 25:
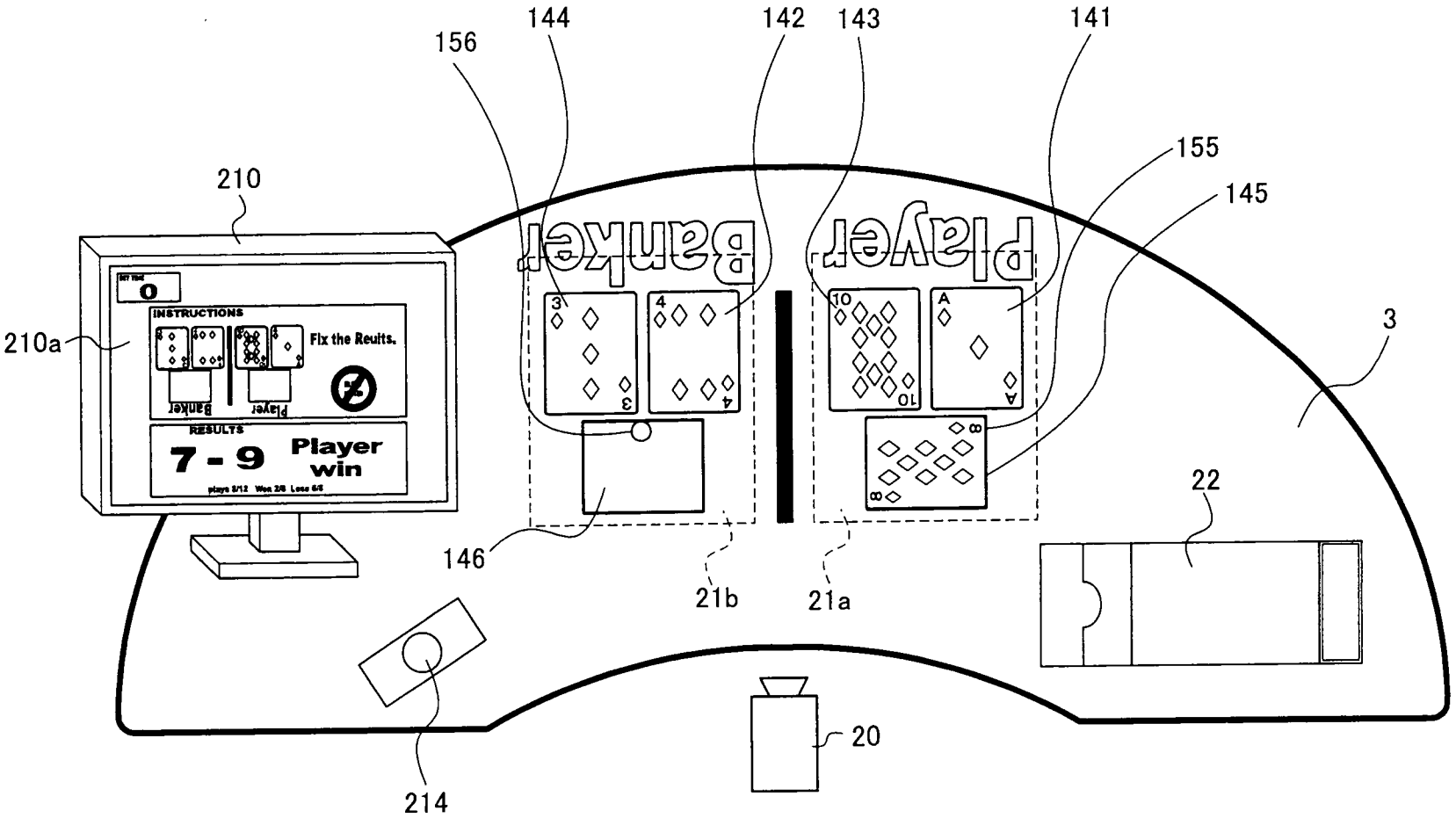
FIG. 25 is a view showing an appearance of the game portion according to the embodiment of the present invention.
Figure 26:
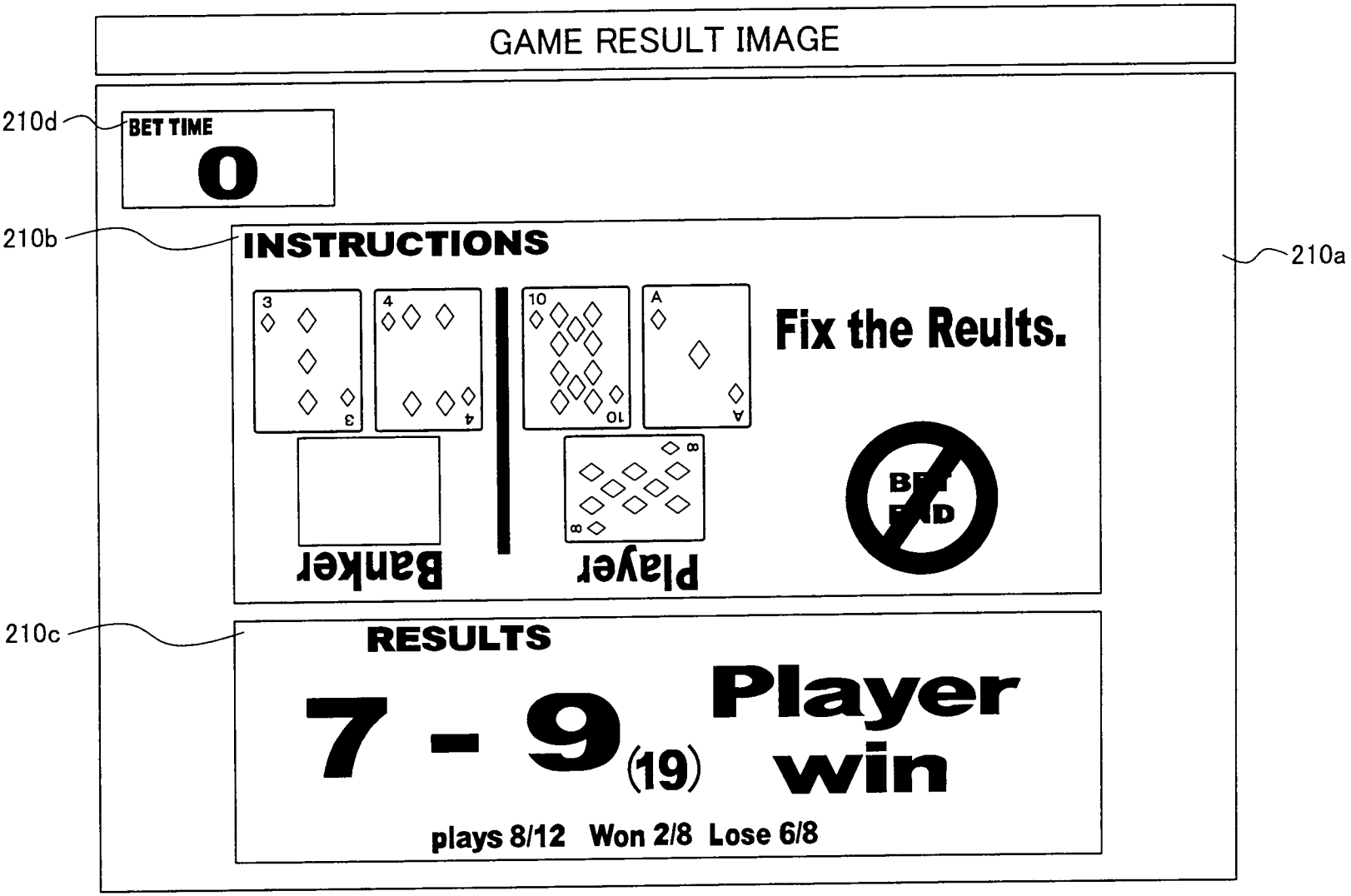
FIG. 26 is a view showing a display example of a dealer-used display according to the embodiment of the present invention.

The game result display processing is explained hereinafter with reference to FIGS. 24 to 26. FIG. 24 is a flowchart showing the game result display processing. FIG. 25 is a view showing an appearance of the game portion 3 at a point when winning/losing in a baccarat game has been determined. FIG. 26 is a diagram showing the game result image.

In Step S71, the CPU 81 performs win determination. More specifically, the CPU 81 determines a win based on information of cards placed on the player side and the banker side.

The result of win determination (game result) is any of "Player (player position" win, "Banker (banker position)" win, or "Tie (draw)".

In Step S72, the CPU 81 displays a picture of the game result on the dealer-used display. More specifically, the CPU 81 displays a picture of the game result shown in FIG. 26 on the dealer-used display 210.

Here, an aspect at a point when a baccarat game outcome has been determined is explained with reference to FIGS. 25 and 26.

FIG. 25 is a view showing the game portion 3 at the point when an outcome in a baccarat game has been determined in Step S71 in FIG. 24, after the card placement advancement processing shown in FIG. 13 is ended. According to FIG. 25, four cards are respectively placed on the card placement areas 141 to 144. The game result image shown in FIG. 26 is displayed on the display area 210*a* of the dealer-used display 210.

FIG. 26 is a view showing a game result image, and the image for navigating the dealer that the "BET END" button (operation input button 214) should not be pressed since the game result has been settled is displayed in the display area 210*b*. An image showing the result of a current game is displayed in the display area 210*c*. The facts that the time in which betting is possible is 0, and that the betting period has ended are shown in the display area 210*d*.

In Step S73 of FIG. 24, the CPU 81 sends data of the game result to the plurality of stations. More specifically, the CPU 81 sends data of the game result (e.g., data indicating the player side wins by 6 to 9) to each of the stations 4. Furthermore, on the stations 4 having received data of this game result, the CPU 111 in the station control portion 110 displays a picture of the game result via the liquid crystal drive circuit 120 on the image display device 7, based on the data of this game result. Moreover, the CPU 111 performs payout based on a bet amount. These allow for a picture of the game result to be displayed on each station 4 while payout is being performed based on a bet amount. When the processing of Step S73 ends, the CPU 81 ends game result display processing.

Figure 27:
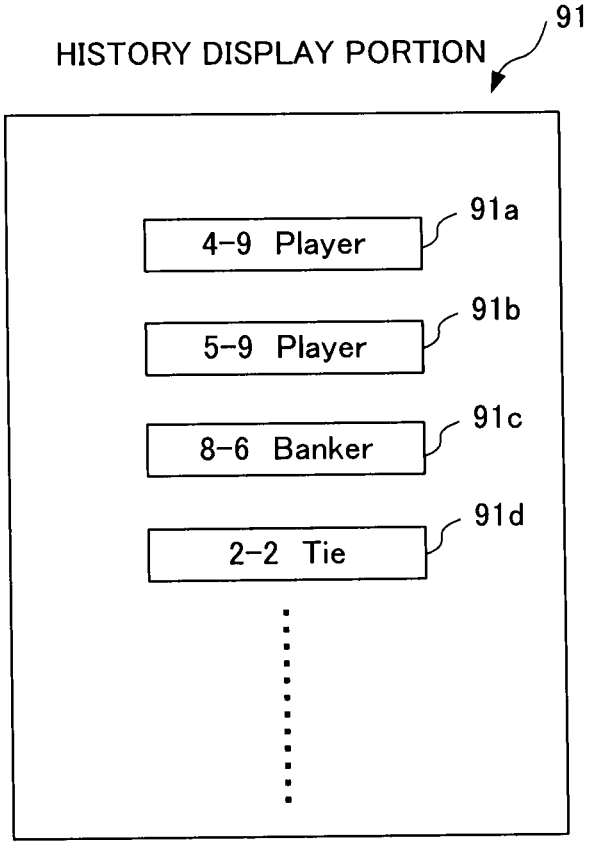
FIG. 27 is a view showing a display example of a display screen of a history display portion according to the embodiment of the present invention.

Display of the history display portion 91 is described with reference to FIG. 27. FIG. 27 is a view showing an example of a image displayed by display screen of the history display portion.

Display areas 91*a*, 91*b*, 91*c*, 91*d* . . . for displaying game history are established on the display screen of the history display portion 91. The game result of a game one prior to the current game is displayed in the display area 91*a*. The game result of games two prior, three prior, four prior . . . to the current game are displayed in the display areas 91*b*, 91*c*, 91*d* . . . , respectively.

The player side having won by 4 to 9 is shown as the display contents of the display area 91*a*. The player side having won by 5 to 9 is shown as the display contents of the display area 91*b*. The banker side having won by 8 to 6 is shown as the display contents of the display area 91*c*. There being a tie of 2 to 2 is shown as the display contents of the display area 91*d*.

It should be noted that a plurality of LED luminous bodies (not illustrated) are disposed around the history display portion 91, and this plurality of LED luminous bodies emit light in various lighting states according to game advancement and the like.

An explanation of the present embodiment has been provided above. Although an explanation has been provided for the case of a baccarat game, the present invention is not limited thereto, and may be a card game such as poker or black jack, and may be a game other than a card game, for example, a dice game such as SICBO, or a roulette game.

In the present embodiment, although an instruction was made to a dealer so that an operation input button 214 is operated by displaying a bet end instructional image on the display area 210*a* of the dealer-used display 210, it is not limited thereto, and a lamp may be provided at a location visible to the dealer (e.g., on the game portion 3 or the like) as an instructional device and instruction may be performed by illumination of the lamp, an LED luminous body may be provided in an operation input button 214 as an instructional device and instructions may be performed by illumination of the LED luminous body, or a device may be provided on the operation input button 214 as an instructional device that causes a physical change to occur in the button (e.g., raises the button).

In particular, in SICBO or roulette, it is not necessary to output at instruction for the placement location of a card to the dealer, and game advancement is possible with only an operation input button; therefore, installation of a display can be omitted.

In the present embodiment, image recognition processing for a predetermined frame among image data captured by the camera 20 is performed, each area of the card placement areas 141 to 146 portion is compared with the card placement areas 141 to 146 portion of the standard image data, and in the case of being different, recognition processing and warning processing are performed when a card has been placed on the card placement areas 141 to 146; however, it is not limited thereto. As the timing to perform recognition processing, for example, it may be configured such that, without acquiring standard image data in advance, a frame of image data at a certain moment is compared with the frame before this frame, and the difference therebetween is determined, and in a case in which there being a difference, recognition processing is performed. Since the frame of image data acquired based on a refresh rate of the camera 20 is compared with the frame immediately before, it is possible to perform image recognition processing in real-time by constantly applying the newest state thereof. For example, in a case in which a scratch or damage occurs within the card placement areas 141 to 146, since it constantly becomes different from the standard image data, there is a possibility for abnormal behavior to occur such as warning display appearing constantly. However, even in such a case, since the recognition processing is performed in a state in which this state has been reflected, it is possible to continue recognition processing without interrupting the processing.

In addition, it may be configured so that a sensor indicating that a card has been taken out is provided in the card shoe 22, and image recognition processing is performed in response to the CPU 81 receiving a detection signal from the sensor indicating that a card has been drawn out. More specifically, the sensor is disposed at a front edge of an upper plate 226 of the card shoe 22. This sensor uses a sensor of a photo-interrupter system disposed so that the light-emitting part and light-receiving part are opposed, for example. More specifically, the sensor is provided so that light generated by the luminous element of the light-emitting part is constantly incident on a light-receiving element of the light-receiving part, and a constant output current is output from the light-receiving element. When a card passes through here, since the light between the light-receiving element and light-emitting element is interrupted, there is no entrance of light into the light-receiving element, and the output current output by the light-receiving element decreases as well. It is possible to detect the drawing out of a card by way of the change in this output current. In this case, since it is necessary for the card to pass between the light-receiving part and the light-emitting part, it is preferred that either one of the light-emitting part or the light-receiving part is disposed so as to be embedded in the base portion 225, and the other one is disposed at a position on a line extending from the upper plate 226. Otherwise, an existing sensor or system such as detection by way of a switch that is depressed in response to a card passing therethrough or the like may be configured so as to be employed. As a result, it is possible to reduce the processing load on the control unit 2 since it is made such that the image recognition process is performed only when the game has started and a card has actually been placed on the card placement areas 141 to 146.

Alternatively, in a case in which a sensor is provided to the card shoe 22, it may be configured so that a scanner is included in place of the sensor or in addition thereto, and a card drawn out from the card shoe 22 is scanned and information of the card (number value, pattern, etc.) is transmitted to the control unit 2. In addition, in this case, it may be configured so that, in the verification/warning processing of FIG. 20, it may be determined whether the card drawn out from the card shoe 22 is the same as the card placed on the card placement areas 141 to 146, based on information of the card thus obtained by the scanner provided in the card shoe 22. As a result, it is possible to prevent fraud such as switching the card during the card being placed on the card placement areas 141 to 146 from the card shoe 22.

In the present embodiment, a case is explained in which the controller of the present invention is configured with a CPU 81 provided to the main control portion 80 and the CPU 111 provided to the station 4; however, the controller of the present invention may be configured with only one CPU.

Although an embodiment of the present invention has been explained above, it is merely exemplified as a specific example, and the present invention is not particularly limited thereto; specific configurations of each means and the like can be suitably modified in design. In addition, the effects described in the embodiment of the present invention are merely listed as the most preferred effects arising from the present invention, and the effects according to the present invention are not limited to those described in the embodiment of the present invention.

What is claimed is:

1. A gaming system that executes a card game, comprising:

a plurality of stations;

a control unit that transmits and receives information related to a card game with the plurality of stations, and controls advancement of the card game;

a game portion that has a flat surface and has a plurality of card placement areas on which cards required to determine a winning of the card game are placed, the plurality of card placement areas being placed in front of a position at which a dealer stands and including a plurality of first card placement areas for a player and a plurality of second card placement areas for a banker, wherein the game portion further includes a plurality of illuminating indicators, wherein an illuminating indicator of the plurality of illuminating indicators is provided in each card placement area among the first card placement areas for the player and the plurality of second card placement areas for the banker, wherein each of the plurality of illuminating indicators corresponds to the card placement area in which it is provided;

an image input device that captures an image of the game portion including the plurality of card placement areas, and transmits captured image to the control unit;

a card shoe that accommodates cards used in the card game; and memory that stores a game advancement program related to advancement of the game, and stores captured images of card placement areas of the game portion and comparative images for performing image recognition processing, wherein the control unit includes a controller that executes processing of:

(a) starting the card game based on the game advancement program, (b) executing image recognition processing for the image of the card placement area captured by the image input device, and (c) calculating a score of the card game according to the game advancement program stored in the memory based on a result of the image recognition processing, wherein executing the image recognition processing includes (b1) determining whether the captured image of the card placement area includes a face on which a numeral or a symbol of a card is marked, and (b2) comparing the captured image of the card placement area with the comparative images stored in the memory when the captured image of the card placement area includes the face, and wherein after a certain card is placed on any one of the plurality of card placement areas, the controller illuminates the illuminating indicator which corresponds to the card placement area on which a next card is to be placed among the plurality of first card placement areas for the player and the plurality of second card placement areas for the banker.

2. The gaming system according to claim 1, wherein the image recognition processing is performed a plurality of times in the processing of (b), and the processing of (c) is performed when results of the image recognition processing that are performed the plurality of times are the same.

3. A gaming system that executes a card game, comprising:

a plurality of stations;

a control unit that transmits and receives information related to a card game with the plurality of stations, and controls advancement of the card game;

a game portion that has a flat surface and has a plurality of card placement areas on which cards required to determine a winning of the card game are placed, the plurality of card replacement areas being placed in front of a position at which a dealer stands and including a plurality of first card placement areas for a player and a plurality of second card placement areas for a banker; wherein the game portion further includes a plurality of illuminating indicators, wherein an illuminating indicator of the plurality of illuminating indicators is provided in each card placement area among the first card placement areas for the player and the plurality of second card placement areas for the banker, wherein each of the plurality of illuminating indicators corresponds to the card placement area in which it is provided, an image input device that captures an image of the game portion including the plurality of card placement areas, and transmits captured image to the control unit;

a card shoe that accommodates cards used in the card game;

memory that stores a game advancement program related to advancement of the game, and stores captured images of card placement areas of the game portion and comparative images for performing image recognition processing; and an instructional device that provides information related to advancement of the game to the dealer, wherein the control unit includes a controller that executes processing of:

(a) starting the card game, and presenting on the instructional device drawing out a card from the card shoe based on the game advancement program, (b) executing image recognition processing for the image of the card placement area captured by the image input device, wherein executing the image recognition processing includes determining whether the captured image of the card placement area includes a face on which a numeral or a symbol of a card is marked, and comparing the captured image of the card placement area with the comparative images stored in the memory when the captured image of the card placement area includes the face when the captured image includes the face, (c) calculating a score of the card game according to the game advancement program stored in the memory based on a result of the image recognition processing, (d) repeating the image recognition processing when the captured image does not include the face in the processing of (b), (e) determining whether the card is further placed on any of the plurality of card placement areas, based on the score calculated in the processing of (c), (f) presenting on the instructional device an instruction for drawing out a card from the card shoe when it is determined to further place the card in the processing of (e), (g) determining the winning of the card game when it is determined not to further place the card in the processing of (e), and (h) presenting the winning of the card game on the instructional device, wherein after a certain card is placed on any one of the plurality of card placement areas, the controller illuminates the illuminating indicator which corresponds to the card placement area on which a next card is to be placed among the plurality of first card placement areas for the player and the plurality of second card placement areas for the banker.

4. The gaming system according to claim 3, wherein when the card is not recognized after the image recognition processing is repeated a predetermined number of time in the processing of (d), a warning for notifying a failure of recognizing the card is presented on the instructional device.

5. The gaming system according to claim 3, wherein the processing of (b) and (c) is repeated a plurality of time, and when the score calculated each time is the same score, the processing of (e) is performed.

6. The gaming system according to claim 3, wherein the plurality of comparative images are stored in the memory for each group of cards used in the game.

7. The gaming system according to claim 1, wherein the image recognition processing is executed after the certain card is placed on any one of the plurality of card placement areas according to the indicator.

8. The gaming system according to claim 3, wherein the image recognition processing is executed after the certain card is placed on any one of the plurality of card placement areas according to the indicator.

* * * * *